US008786592B2

(12) United States Patent
Van Lier

(10) Patent No.: US 8,786,592 B2
(45) Date of Patent: Jul. 22, 2014

(54) METHODS AND SYSTEMS FOR ENERGY RECOVERY IN A DISPLAY

(75) Inventor: Wilhelmus Johannes Robertus Van Lier, San Diego, CA (US)

(73) Assignee: Qualcomm MEMS Technologies, Inc., San Diego, CA (US)

( * ) Notice: Subject to any disclaimer, the term of this patent is extended or adjusted under 35 U.S.C. 154(b) by 309 days.

(21) Appl. No.: 13/273,030

(22) Filed: Oct. 13, 2011

(65) Prior Publication Data

US 2013/0093744 A1 Apr. 18, 2013

(51) Int. Cl.
*G09G 5/00* (2006.01)

(52) U.S. Cl.
USPC ..... 345/212; 345/98; 345/100; 345/211

(58) Field of Classification Search
USPC ..... 345/68, 98, 100, 211, 212
See application file for complete search history.

(56) References Cited

U.S. PATENT DOCUMENTS

| | | | | |
|---|---|---|---|---|
| 4,954,789 | A | 9/1990 | Sampsell | |
| 5,784,189 | A | 7/1998 | Bozler et al. | |
| 5,821,923 | A | 10/1998 | Van Amesfoort et al. | |
| 6,040,937 | A | 3/2000 | Miles | |
| 6,538,627 | B1 | 3/2003 | Whang et al. | |
| 6,574,033 | B1 | 6/2003 | Chui et al. | |
| 6,674,562 | B1 | 1/2004 | Miles et al. | |
| 7,042,423 | B2 | 5/2006 | Iwami | |
| 7,042,643 | B2 | 5/2006 | Miles | |
| 7,123,216 | B1 | 10/2006 | Miles | |
| 7,327,510 | B2 | 2/2008 | Cummings et al. | |
| 7,560,299 | B2 | 7/2009 | Cummings | |
| 7,777,715 | B2 | 8/2010 | Chui et al. | |
| 7,889,163 | B2 | 2/2011 | Chui et al. | |
| 7,990,604 | B2 | 8/2011 | Lee et al. | |
| 2004/0246226 | A1* | 12/2004 | Moon | 345/102 |
| 2007/0177129 | A1* | 8/2007 | Kothari et al. | 356/32 |
| 2007/0188437 | A1 | 8/2007 | Peron et al. | |
| 2007/0189654 | A1 | 8/2007 | Lasiter | |
| 2010/0013865 | A1 | 1/2010 | Sarrasin | |
| 2010/0245311 | A1 | 9/2010 | Lewis et al. | |
| 2010/0245313 | A1 | 9/2010 | Lewis et al. | |

FOREIGN PATENT DOCUMENTS

| | | | |
|---|---|---|---|
| EP | 1548694 | A1 | 6/2005 |
| EP | 1933296 | A2 | 6/2008 |
| WO | 2005039033 | A1 | 4/2005 |

OTHER PUBLICATIONS

International Search Report and Written Opinion—PCT/US2012/058622—ISA/EPO—Dec. 20, 2012.

* cited by examiner

*Primary Examiner* — Premal Patel
(74) *Attorney, Agent, or Firm* — Knobbe, Martens, Olson & Bear LLP

(57) ABSTRACT

Systems, methods and apparatus, including computer programs encoded on computer storage media, are used for driving a display. In one aspect, the method includes connecting a first segment line to a first voltage, connecting a second segment line to a second voltage, and connecting the least a first segment line to the second segment line through at least one inductor. The polarities of segment line voltages may therefore be switched by reusing energy in the system.

23 Claims, 16 Drawing Sheets

Common Voltages

| Segment Voltages | $VC_{ADD_H}$ | $VC_{HOLD_H}$ | $VC_{REL}$ | $VC_{HOLD_L}$ | $VC_{ADD_L}$ |
|---|---|---|---|---|---|
| $VS_H$ | Stable | Stable | Relax | Stable | Actuate |
| $VS_L$ | Actuate | Stable | Relax | Stable | Stable |

METHODS AND SYSTEMS FOR ENERGY RECOVERY IN A DISPLAY

TECHNICAL FIELD

This disclosure is related to methods and systems for driving electromechanical systems such as interferometric modulators.

DESCRIPTION OF THE RELATED TECHNOLOGY

Electromechanical systems (EMS) include devices having electrical and mechanical elements, actuators, transducers, sensors, optical components (such as mirrors and optical film layers) and electronics. Electromechanical systems can be manufactured at a variety of scales including, but not limited to, microscales and nanoscales. For example, microelectromechanical systems (MEMS) devices can include structures having sizes ranging from about a micron to hundreds of microns or more. Nanoelectromechanical systems (NEMS) devices can include structures having sizes smaller than a micron including, for example, sizes smaller than several hundred nanometers. Electromechanical elements may be created using deposition, etching, lithography, and/or other micromachining processes that etch away parts of substrates and/or deposited material layers, or that add layers to form electrical and electromechanical devices.

One type of electromechanical systems device is called an interferometric modulator (IMOD). As used herein, the term interferometric modulator or interferometric light modulator refers to a device that selectively absorbs and/or reflects light using the principles of optical interference. In some implementations, an interferometric modulator may include a pair of conductive plates, one or both of which may be transparent and/or reflective, wholly or in part, and capable of relative motion upon application of an appropriate electrical signal. In an implementation, one plate may include a stationary layer deposited on a substrate and the other plate may include a reflective membrane separated from the stationary layer by an air gap. The position of one plate in relation to another can change the optical interference of light incident on the interferometric modulator. Interferometric modulator devices have a wide range of applications, and are anticipated to be used in improving existing products and creating new products, especially those with display capabilities.

SUMMARY

The systems, methods and devices of the disclosure each have several innovative aspects, no single one of which is solely responsible for the desirable attributes disclosed herein.

One innovative aspect of the subject matter described in this disclosure can be implemented in a method of driving a display including a plurality of segment lines. The method may include transferring charge between segment lines through at least one inductor.

According to some aspects, a circuit for driving a display including a plurality of segment lines is disclosed. The circuit includes a power supply, a first segment line, and a second segment line. The circuit further includes at least one inductor, a first switching circuit configured to selectively connect the first segment line to one of the power supply and the at least one inductor, and a second switching circuit configured to selectively connect the second segment line to one of the power supply and the at least one inductor.

According to some aspects, a circuit for driving a display including a plurality of segment lines is disclosed. The circuit includes a power source selectively coupled to the plurality of segment lines and means for transferring charge between segment lines through at least one inductor.

According to some aspects, a computer program product for processing data for a program configured to drive a display including a plurality of segment lines is disclosed. The computer program product including a non-transitory computer-readable medium having stored thereon code for causing a computer to transfer charge between segment lines through at least one inductor.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DETAILED DESCRIPTION

Figure 1:
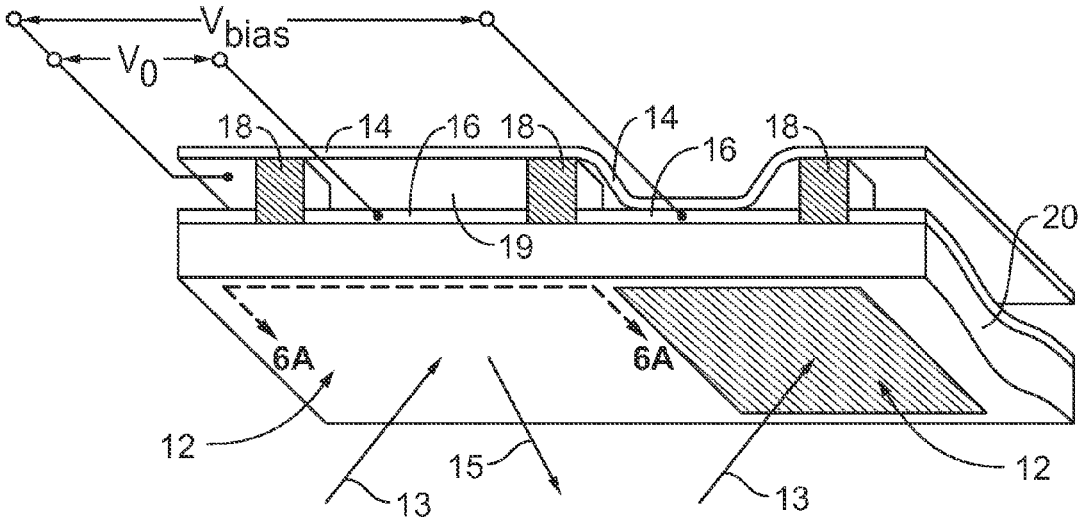
FIG. 1 shows an example of an isometric view depicting two adjacent pixels in a series of pixels of an interferometric modulator (IMOD) display device.

The following description is directed to certain implementations for the purposes of describing the innovative aspects of this disclosure. However, a person having ordinary skill in the art will readily recognize that the teachings herein can be applied in a multitude of different ways. The described implementations may be implemented in any device or system that can be configured to display an image, whether in motion (e.g., video) or stationary (e.g., still image), and whether textual, graphical or pictorial. More particularly, it is contemplated that the described implementations may be included in or associated with a variety of electronic devices such as, but not limited to: mobile telephones, multimedia Internet enabled cellular telephones, mobile television receivers, wireless devices, smartphones, Bluetooth® devices, personal data assistants (PDAs), wireless electronic mail receivers, hand-held or portable computers, netbooks, notebooks, smartbooks, tablets, printers, copiers, scanners, facsimile devices, GPS receivers/navigators, cameras, MP3 players, camcorders, game consoles, wrist watches, clocks, calculators, television monitors, flat panel displays, electronic reading devices (i.e., e-readers), computer monitors, auto displays (including odometer and speedometer displays, etc.), cockpit controls and/or displays, camera view displays (such as the display of a rear view camera in a vehicle), electronic photographs, electronic billboards or signs, projectors, architectural structures, microwaves, refrigerators, stereo systems, cassette recorders or players, DVD players, CD players, VCRs, radios, portable memory chips, washers, dryers, washer/dryers, parking meters, packaging (such as in electromechanical systems (EMS), microelectromechanical systems (MEMS) and non-MEMS applications), aesthetic structures (e.g., display of images on a piece of jewelry) and a variety of EMS devices. The teachings herein also can be used in non-display applications such as, but not limited to, electronic switching devices, radio frequency filters, sensors, accelerometers, gyroscopes, motion-sensing devices, magnetometers, inertial components for consumer electronics, parts of consumer electronics products, varactors, liquid crystal devices, electrophoretic devices, drive schemes, manufacturing processes and electronic test equipment. Thus, the teachings are not intended to be limited to the implementations depicted solely in the Figures, but instead have wide applicability as will be readily apparent to one having ordinary skill in the art.

According to some implementations, a switching circuit is provided for selectively connecting an interferometric modulator component to a positive voltage VS+, a negative VS−, a first switching rail, and a second switching rail. Each of the first and second switching rails is connected to an inductor through a switch. The polarity of the driving voltage is switched in order to reduce a build up of charge in the interferometric modulator component. When the polarity is switched, the interferometric modulator component is connected to an inductor through a switching rail by closing the associated switches. The component is thereby discharged through the switching rail and the connected inductor. A component which is being switched to the opposite polarity is also connected to the inductor through the second switching rail such that it is charged through the inductor. With this process, the discharged voltage of one segment may be used to charge the voltage of another segment, thereby reducing the amount of power consumption in the system.

According to some implementations, each switching rail may be connected to a separate inductor, such that there at least two inductors in the circuit. In a circuit having two inductors, the number of components being switched from a positive voltage to a negative voltage may not be equal to the number of components being switched from the negative voltage to the positive voltage. A charging current through each inductor may be used to charge any number of components undergoing a polarity switch. With this process, the discharged voltage of any number of first components may be used to charge any number of second components, thereby reducing the amount of power consumption in the system.

Particular implementations of the subject matter described in this disclosure can be implemented to realize one or more of the following potential advantages. An amount of energy consumed in driving a display device may be reduced by reusing energy in the system. The energy consumption may also be reduced even when a polarity switching operation is non-symmetric. The energy consumed may be reduced by up to 75% over prior art segment switching operations.

An example of a suitable EMS or MEMS device, to which the described implementations may apply, is a reflective display device. Reflective display devices can incorporate interferometric modulators (IMODs) to selectively absorb and/or reflect light incident thereon using principles of optical interference. IMODs can include an absorber, a reflector that is movable with respect to the absorber, and an optical resonant cavity defined between the absorber and the reflector. The reflector can be moved to two or more different positions, which can change the size of the optical resonant cavity and thereby affect the reflectance of the interferometric modulator. The reflectance spectrums of IMODs can create fairly broad spectral bands which can be shifted across the visible wavelengths to generate different colors. The position of the spectral band can be adjusted by changing the thickness of the optical resonant cavity. One way of changing the optical resonant cavity is by changing the position of the reflector.

FIG. 1 shows an example of an isometric view depicting two adjacent pixels in a series of pixels of an interferometric modulator (IMOD) display device. The IMOD display device includes one or more interferometric MEMS display elements. In these devices, the pixels of the MEMS display elements can be in either a bright or dark state. In the bright ("relaxed," "open" or "on") state, the display element reflects a large portion of incident visible light, e.g., to a user. Conversely, in the dark ("actuated," "closed" or "off") state, the display element reflects little incident visible light. In some implementations, the light reflectance properties of the on and off states may be reversed. MEMS pixels can be configured to reflect predominantly at particular wavelengths allowing for a color display in addition to black and white.

The IMOD display device can include a row/column array of IMODs. Each IMOD can include a pair of reflective layers, i.e., a movable reflective layer and a fixed partially reflective layer, positioned at a variable and controllable distance from each other to form an air gap (also referred to as an optical gap or cavity). The movable reflective layer may be moved between at least two positions. In a first position, i.e., a relaxed position, the movable reflective layer can be positioned at a relatively large distance from the fixed partially reflective layer. In a second position, i.e., an actuated position, the movable reflective layer can be positioned more closely to the partially reflective layer. Incident light that reflects from the two layers can interfere constructively or destructively depending on the position of the movable reflective layer, producing either an overall reflective or non-reflective state for each pixel. In some implementations, the IMOD may be in a reflective state when unactuated, reflecting light within the visible spectrum, and may be in a dark state when unactuated, absorbing and/or destructively interfering light within the visible range. In some other implementations, however, an IMOD may be in a dark state when unactuated, and in a reflective state when actuated. In some implementations, the introduction of an applied voltage can drive the pixels to change states. In some other implementations, an applied charge can drive the pixels to change states.

The depicted portion of the pixel array in FIG. 1 includes two adjacent interferometric modulators 12. In the IMOD 12 on the left (as illustrated), a movable reflective layer 14 is illustrated in a relaxed position at a predetermined distance from an optical stack 16, which includes a partially reflective layer. The voltage $V_0$ applied across the IMOD 12 on the left is insufficient to cause actuation of the movable reflective layer 14. In the IMOD 12 on the right, the movable reflective layer 14 is illustrated in an actuated position near or adjacent the optical stack 16. The voltage $V_{bias}$ applied across the IMOD 12 on the right is sufficient to maintain the movable reflective layer 14 in the actuated position.

In FIG. 1, the reflective properties of pixels 12 are generally illustrated with arrows 13 indicating light incident upon the pixels 12, and light 15 reflecting from the pixel 12 on the left. Although not illustrated in detail, it will be understood by a person having ordinary skill in the art that most of the light 13 incident upon the pixels 12 will be transmitted through the transparent substrate 20, toward the optical stack 16. A portion of the light incident upon the optical stack 16 will be transmitted through the partially reflective layer of the optical stack 16, and a portion will be reflected back through the transparent substrate 20. The portion of light 13 that is transmitted through the optical stack 16 will be reflected at the movable reflective layer 14, back toward (and through) the transparent substrate 20. Interference (constructive or destructive) between the light reflected from the partially reflective layer of the optical stack 16 and the light reflected from the movable reflective layer 14 will determine the wavelength(s) of light 15 reflected from the pixel 12.

The optical stack 16 can include a single layer or several layers. The layer(s) can include one or more of an electrode layer, a partially reflective and partially transmissive layer and a transparent dielectric layer. In some implementations, the optical stack 16 is electrically conductive, partially transparent and partially reflective, and may be fabricated, for example, by depositing one or more of the above layers onto a transparent substrate 20. The electrode layer can be formed from a variety of materials, such as various metals, for example indium tin oxide (ITO). The partially reflective layer can be formed from a variety of materials that are partially reflective, such as various metals, such as chromium (Cr), semiconductors, and dielectrics. The partially reflective layer can be formed of one or more layers of materials, and each of the layers can be formed of a single material or a combination of materials. In some implementations, the optical stack 16 can include a single semi-transparent thickness of metal or semiconductor which serves as both an optical absorber and electrical conductor, while different, electrically more conductive layers or portions (e.g., of the optical stack 16 or of other structures of the IMOD) can serve to bus signals between IMOD pixels. The optical stack 16 also can include one or more insulating or dielectric layers covering one or more conductive layers or an electrically conductive/optically absorptive layer.

In some implementations, the layer(s) of the optical stack 16 can be patterned into parallel strips, and may form row electrodes in a display device as described further below. As will be understood by one having ordinary skill in the art, the term "patterned" is used herein to refer to masking as well as etching processes. In some implementations, a highly conductive and reflective material, such as aluminum (Al), may be used for the movable reflective layer 14, and these strips may form column electrodes in a display device. The movable reflective layer 14 may be formed as a series of parallel strips of a deposited metal layer or layers (orthogonal to the row electrodes of the optical stack 16) to form columns deposited on top of posts 18 and an intervening sacrificial material deposited between the posts 18. When the sacrificial material is etched away, a defined gap 19, or optical cavity, can be formed between the movable reflective layer 14 and the optical stack 16. In some implementations, the spacing between posts 18 may be approximately 1-1000 um, while the gap 19 may be less than <10,000 Angstroms (Å).

In some implementations, each pixel of the IMOD, whether in the actuated or relaxed state, is essentially a capacitor formed by the fixed and moving reflective layers. When no voltage is applied, the movable reflective layer 14 remains in a mechanically relaxed state, as illustrated by the pixel 12 on the left in FIG. 1, with the gap 19 between the movable reflective layer 14 and optical stack 16. However, when a potential difference, a voltage, is applied to at least one of a selected row and column, the capacitor formed at the intersection of the row and column electrodes at the corresponding pixel becomes charged, and electrostatic forces pull the electrodes together. If the applied voltage exceeds a threshold, the movable reflective layer 14 can deform and move near or against the optical stack 16. A dielectric layer (not shown) within the optical stack 16 may prevent shorting and control the separation distance between the layers 14 and 16, as illustrated by the actuated pixel 12 on the right in FIG. 1. The behavior is the same regardless of the polarity of the applied potential difference. Though a series of pixels in an array may be referred to in some instances as "rows" or "columns," a person having ordinary skill in the art will readily understand that referring to one direction as a "row" and another as a "column" is arbitrary. Restated, in some orientations, the rows can be considered columns, and the columns considered to be rows. Furthermore, the display elements may be evenly arranged in orthogonal rows and columns (an "array"), or arranged in non-linear configurations, for example, having certain positional offsets with respect to one another (a "mosaic"). The terms "array" and "mosaic" may refer to either configuration. Thus, although the display is referred to as including an "array" or "mosaic," the elements themselves need not be arranged orthogonally to one another, or disposed in an even distribution, in any instance, but may include arrangements having asymmetric shapes and unevenly distributed elements.

Figure 2:
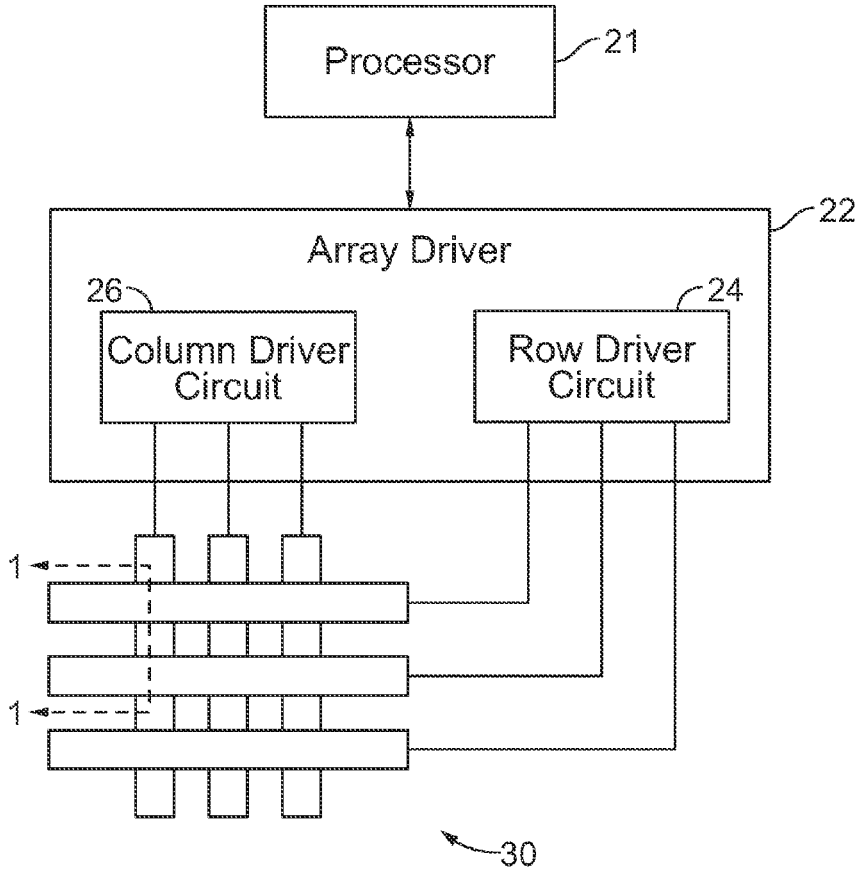
FIG. 2 shows an example of a system block diagram illustrating an electronic device incorporating a 3×3 interferometric modulator display.

FIG. 2 shows an example of a system block diagram illustrating an electronic device incorporating a 3×3 interferometric modulator display. The electronic device includes a processor 21 that may be configured to execute one or more software modules. In addition to executing an operating system, the processor 21 may be configured to execute one or more software applications, including a web browser, a telephone application, an email program, or any other software application.

The processor 21 can be configured to communicate with an array driver 22. The array driver 22 can include a row driver circuit 24 and a column driver circuit 26 that provide signals to, for example, a display array or panel 30. The cross section of the IMOD display device illustrated in FIG. 1 is shown by the lines 1-1 in FIG. 2. Although FIG. 2 illustrates a 3×3 array of IMODs for the sake of clarity, the display array 30 may contain a very large number of IMODs, and may have a different number of IMODs in rows than in columns, and vice versa.

Figures 3, 4:
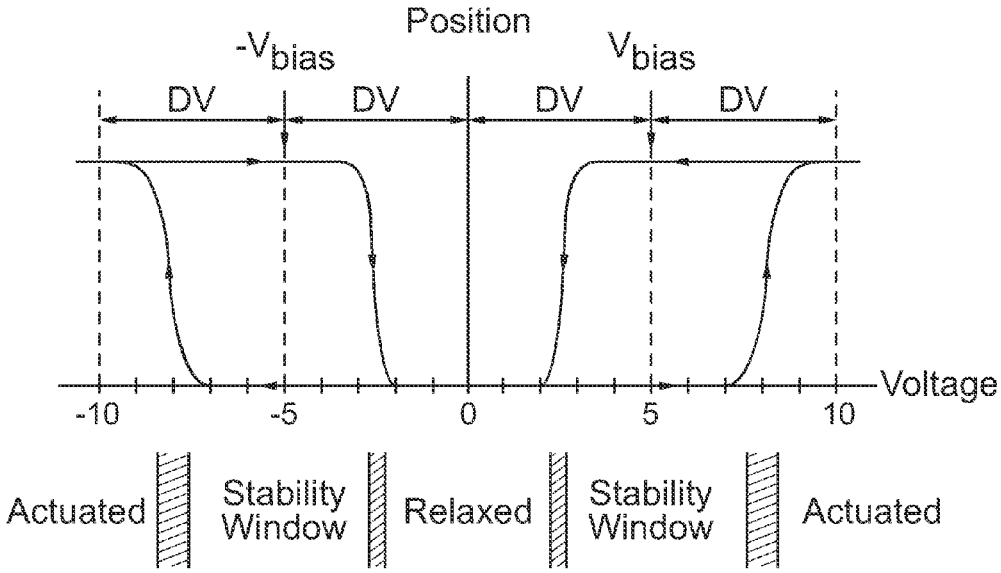
FIG. 3 shows an example of a diagram illustrating movable reflective layer position versus applied voltage for the interferometric modulator of FIG. 1.
FIG. 4 shows an example of a table illustrating various states of an interferometric modulator when various common and segment voltages are applied.

FIG. 3 shows an example of a diagram illustrating movable reflective layer position versus applied voltage for the interferometric modulator of FIG. 1. For MEMS interferometric modulators, the row/column (i.e., common/segment) write procedure may take advantage of a hysteresis property of these devices as illustrated in FIG. 3. An interferometric modulator may use, in one example implementation, about a 10-volt potential difference to cause the movable reflective layer, or mirror, to change from the relaxed state to the actuated state. When the voltage is reduced from that value, the movable reflective layer maintains its state as the voltage drops back below, in this example, 10 volts, however, the movable reflective layer does not relax completely until the voltage drops below 2 volts. Thus, a range of voltage, approximately 3 to 7 volts, in this example, as shown in FIG. 3, exists where there is a window of applied voltage within which the device is stable in either the relaxed or actuated state. This is referred to herein as the "hysteresis window" or "stability window." For a display array 30 having the hysteresis characteristics of FIG. 3, the row/column write procedure can be designed to address one or more rows at a time, such that during the addressing of a given row, pixels in the addressed row that are to be actuated are exposed to a voltage difference of about, in this example, 10 volts, and pixels that are to be relaxed are exposed to a voltage difference of near zero volts. After addressing, the pixels can be exposed to a steady state or bias voltage difference of approximately 5 volts in this example, such that they remain in the previous strobing state. In this example, after being addressed, each pixel sees a potential difference within the "stability window" of about 3-7 volts. This hysteresis property feature enables the pixel design, such as that illustrated in FIG. 1, to remain stable in either an actuated or relaxed pre-existing state under the same applied voltage conditions. Since each IMOD pixel, whether in the actuated or relaxed state, is essentially a capacitor formed by the fixed and moving reflective layers, this stable state can be held at a steady voltage within the hysteresis window without substantially consuming or losing power. Moreover, essentially little or no current flows into the IMOD pixel if the applied voltage potential remains substantially fixed.

In some implementations, a frame of an image may be created by applying data signals in the form of "segment" voltages along the set of column electrodes, in accordance with the desired change (if any) to the state of the pixels in a given row. Each row of the array can be addressed in turn, such that the frame is written one row at a time. To write the desired data to the pixels in a first row, segment voltages corresponding to the desired state of the pixels in the first row can be applied on the column electrodes, and a first row pulse in the form of a specific "common" voltage or signal can be applied to the first row electrode. The set of segment voltages can then be changed to correspond to the desired change (if any) to the state of the pixels in the second row, and a second common voltage can be applied to the second row electrode. In some implementations, the pixels in the first row are unaffected by the change in the segment voltages applied along the column electrodes, and remain in the state they were set to during the first common voltage row pulse. This process may be repeated for the entire series of rows, or alternatively, columns, in a sequential fashion to produce the image frame. The frames can be refreshed and/or updated with new image data by continually repeating this process at some desired number of frames per second.

The combination of segment and common signals applied across each pixel (that is, the potential difference across each pixel) determines the resulting state of each pixel. FIG. 4 shows an example of a table illustrating various states of an interferometric modulator when various common and segment voltages are applied. As will be understood by one having ordinary skill in the art, the "segment" voltages can be applied to either the column electrodes or the row electrodes, and the "common" voltages can be applied to the other of the column electrodes or the row electrodes.

As illustrated in FIG. 4 (as well as in the timing diagram shown in FIG. 5B), when a release voltage $VC_{REL}$ is applied along a common line, all interferometric modulator elements along the common line will be placed in a relaxed state, alternatively referred to as a released or unactuated state, regardless of the voltage applied along the segment lines, i.e., high segment voltage $VS_H$ and low segment voltage $VS_L$. In particular, when the release voltage $VC_{REL}$ is applied along a common line, the potential voltage across the modulator pixels (alternatively referred to as a pixel voltage) is within the relaxation window (see FIG. 3, also referred to as a release window) both when the high segment voltage $VS_H$ and the low segment voltage $VS_L$ are applied along the corresponding segment line for that pixel.

When a hold voltage is applied on a common line, such as a high hold voltage $VC_{HOLD_H}$ or a low hold voltage $VC_{HOLD_L}$, the state of the interferometric modulator will remain constant. For example, a relaxed IMOD will remain in a relaxed position, and an actuated IMOD will remain in an actuated position. The hold voltages can be selected such that the pixel voltage will remain within a stability window both when the high segment voltage $VS_H$ and the low segment voltage $VS_L$ are applied along the corresponding segment line. Thus, the segment voltage swing, i.e., the difference between the high $VS_H$ and low segment voltage $VS_L$, is less than the width of either the positive or the negative stability window.

When an addressing, or actuation, voltage is applied on a common line, such as a high addressing voltage $VC_{ADD_H}$ or a low addressing voltage $VC_{ADD_L}$, data can be selectively written to the modulators along that line by application of segment voltages along the respective segment lines. The segment voltages may be selected such that actuation is dependent upon the segment voltage applied. When an addressing voltage is applied along a common line, application of one segment voltage will result in a pixel voltage within a stability window, causing the pixel to remain unactuated. In contrast, application of the other segment voltage will result in a pixel voltage beyond the stability window, resulting in actuation of the pixel. The particular segment voltage which causes actuation can vary depending upon which addressing voltage is used. In some implementations, when the high addressing voltage $VC_{ADD_H}$ is applied along the common line, application of the high segment voltage $VS_H$ can cause a modulator to remain in its current position, while application of the low segment voltage $VS_L$ can cause actuation of the modulator. As a corollary, the effect of the segment voltages can be the opposite when a low addressing voltage $VC_{ADD_L}$ is applied, with high segment voltage $VS_H$ causing actuation of the modulator, and low segment voltage $VS_L$ having no effect (i.e., remaining stable) on the state of the modulator.

In some implementations, hold voltages, address voltages, and segment voltages may be used which produce the same polarity potential difference across the modulators. In some other implementations, signals can be used which alternate the polarity of the potential difference of the modulators from time to time. Alternation of the polarity across the modulators (that is, alternation of the polarity of write procedures) may reduce or inhibit charge accumulation which could occur after repeated write operations of a single polarity.

Figure 5A:
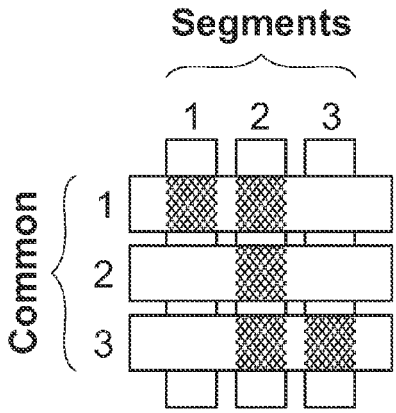
FIG. 5A shows an example of a diagram illustrating a frame of display data in the 3×3 interferometric modulator display of FIG. 2.
Figure 5B:
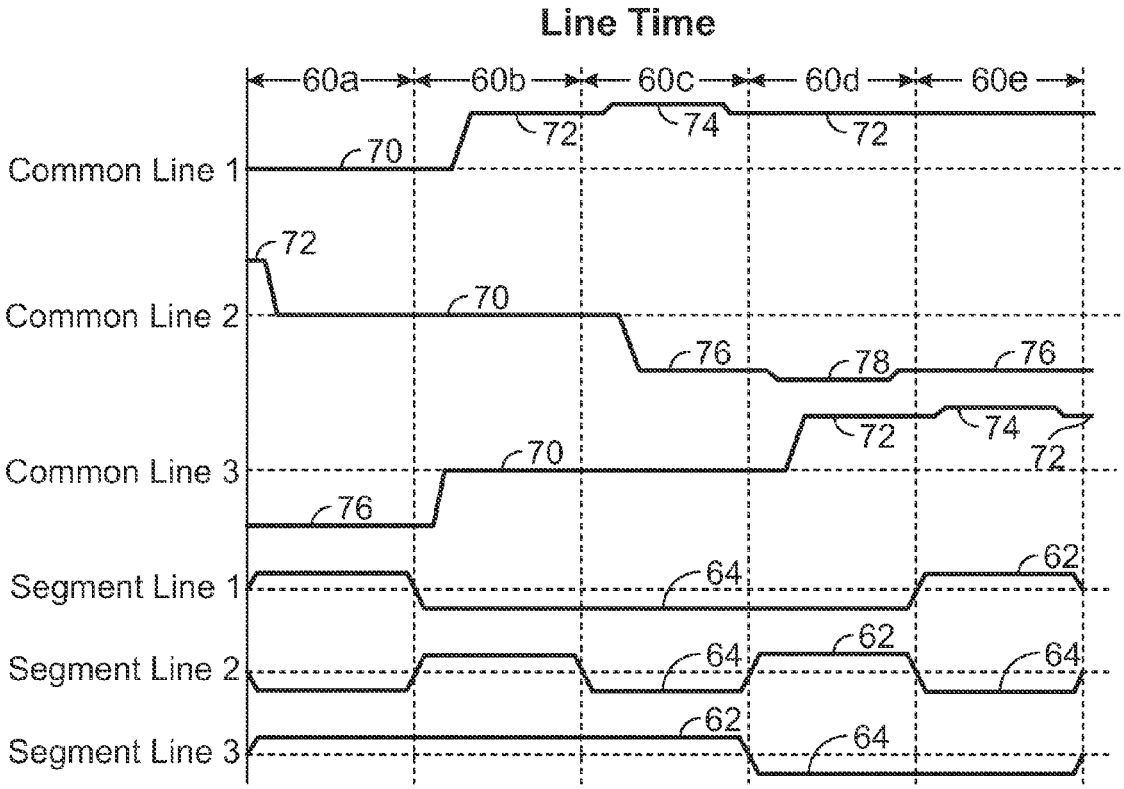
FIG. 5B shows an example of a timing diagram for common and segment signals that may be used to write the frame of display data illustrated in FIG. 5A.

FIG. 5A shows an example of a diagram illustrating a frame of display data in the 3×3 interferometric modulator display of FIG. 2. FIG. 5B shows an example of a timing diagram for common and segment signals that may be used to write the frame of display data illustrated in FIG. 5A. The signals can be applied to a 3×3 array, similar to the array of FIG. 2, which will ultimately result in the line time 60*e* display arrangement illustrated in FIG. 5A. The actuated modulators in FIG. 5A are in a dark-state, i.e., where a substantial portion of the reflected light is outside of the visible spectrum so as to result in a dark appearance to, for example, a viewer. Prior to writing the frame illustrated in FIG. 5A, the pixels can be in any state, but the write procedure illustrated in the timing diagram of FIG. 5B presumes that each modulator has been released and resides in an unactuated state before the first line time 60*a*.

During the first line time 60*a*: a release voltage 70 is applied on common line 1; the voltage applied on common line 2 begins at a high hold voltage 72 and moves to a release voltage 70; and a low hold voltage 76 is applied along common line 3. Thus, the modulators (common 1, segment 1), (1,2) and (1,3) along common line 1 remain in a relaxed, or unactuated, state for the duration of the first line time 60*a*, the modulators (2,1), (2,2) and (2,3) along common line 2 will move to a relaxed state, and the modulators (3,1), (3,2) and (3,3) along common line 3 will remain in their previous state. With reference to FIG. 4, the segment voltages applied along segment lines 1, 2 and 3 will have no effect on the state of the interferometric modulators, as none of common lines 1, 2 or 3 are being exposed to voltage levels causing actuation during line time 60*a* (i.e., $VC_{REL}$—relax and $VC_{HOLD_L}$—stable).

During the second line time 60*b*, the voltage on common line 1 moves to a high hold voltage 72, and all modulators along common line 1 remain in a relaxed state regardless of the segment voltage applied because no addressing, or actuation, voltage was applied on the common line 1. The modulators along common line 2 remain in a relaxed state due to the application of the release voltage 70, and the modulators (3,1), (3,2) and (3,3) along common line 3 will relax when the voltage along common line 3 moves to a release voltage 70.

During the third line time 60*c*, common line 1 is addressed by applying a high address voltage 74 on common line 1. Because a low segment voltage 64 is applied along segment lines 1 and 2 during the application of this address voltage, the pixel voltage across modulators (1,1) and (1,2) is greater than the high end of the positive stability window (i.e., the voltage differential exceeded a predefined threshold) of the modulators, and the modulators (1,1) and (1,2) are actuated. Conversely, because a high segment voltage 62 is applied along segment line 3, the pixel voltage across modulator (1,3) is less than that of modulators (1,1) and (1,2), and remains within the positive stability window of the modulator; modulator (1,3) thus remains relaxed. Also during line time 60*c*, the voltage along common line 2 decreases to a low hold voltage 76, and the voltage along common line 3 remains at a release voltage 70, leaving the modulators along common lines 2 and 3 in a relaxed position.

During the fourth line time 60*d*, the voltage on common line 1 returns to a high hold voltage 72, leaving the modulators along common line 1 in their respective addressed states. The voltage on common line 2 is decreased to a low address voltage 78. Because a high segment voltage 62 is applied along segment line 2, the pixel voltage across modulator (2,2) is below the lower end of the negative stability window of the modulator, causing the modulator (2,2) to actuate. Conversely, because a low segment voltage 64 is applied along segment lines 1 and 3, the modulators (2,1) and (2,3) remain in a relaxed position. The voltage on common line 3 increases to a high hold voltage 72, leaving the modulators along common line 3 in a relaxed state.

Finally, during the fifth line time 60*e*, the voltage on common line 1 remains at high hold voltage 72, and the voltage on common line 2 remains at a low hold voltage 76, leaving the modulators along common lines 1 and 2 in their respective addressed states. The voltage on common line 3 increases to a high address voltage 74 to address the modulators along common line 3. As a low segment voltage 64 is applied on segment lines 2 and 3, the modulators (3,2) and (3,3) actuate, while the high segment voltage 62 applied along segment line 1 causes modulator (3,1) to remain in a relaxed position. Thus, at the end of the fifth line time 60*e*, the 3×3 pixel array is in the state shown in FIG. 5A, and will remain in that state as long as the hold voltages are applied along the common lines, regardless of variations in the segment voltage which may occur when modulators along other common lines (not shown) are being addressed.

In the timing diagram of FIG. 5B, a given write procedure (i.e., line times 60*a*-60*e*) can include the use of either high hold and address voltages, or low hold and address voltages. Once the write procedure has been completed for a given common line (and the common voltage is set to the hold voltage having the same polarity as the actuation voltage), the pixel voltage remains within a given stability window, and does not pass through the relaxation window until a release voltage is applied on that common line. Furthermore, as each modulator is released as part of the write procedure prior to addressing the modulator, the actuation time of a modulator, rather than the release time, may determine the line time. Specifically, in implementations in which the release time of a modulator is greater than the actuation time, the release voltage may be applied for longer than a single line time, as depicted in FIG. 5B. In some other implementations, voltages applied along common lines or segment lines may vary to account for variations in the actuation and release voltages of different modulators, such as modulators of different colors.

Figure 6A:
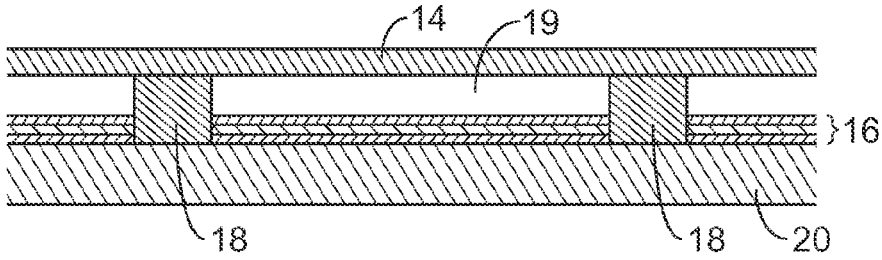
FIG. 6A shows an example of a partial cross-section of the interferometric modulator display of FIG. 1.
Figure 6B:
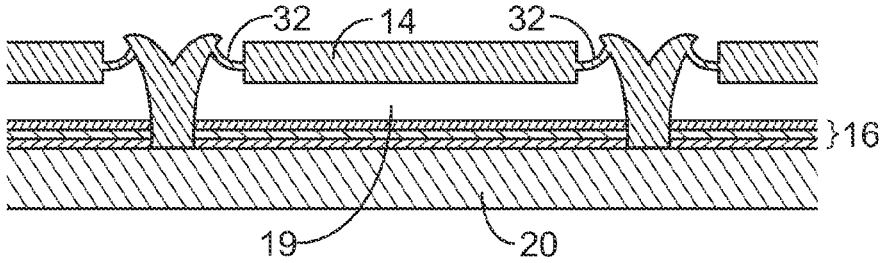
FIGS. 6B-6E show examples of cross-sections of varying implementations of interferometric modulators.
Figure 6C:
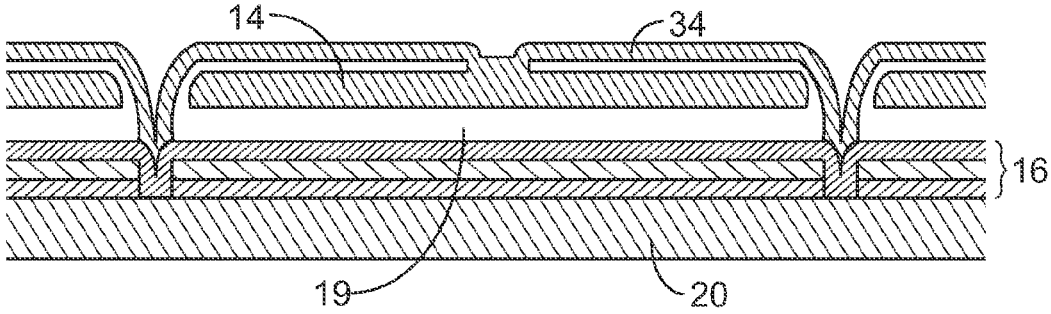

The details of the structure of interferometric modulators that operate in accordance with the principles set forth above may vary widely. For example, FIGS. 6A-6E show examples of cross-sections of varying implementations of interferometric modulators, including the movable reflective layer 14 and its supporting structures. FIG. 6A shows an example of a partial cross-section of the interferometric modulator display of FIG. 1, where a strip of metal material, i.e., the movable reflective layer 14 is deposited on supports 18 extending orthogonally from the substrate 20. In FIG. 6B, the movable reflective layer 14 of each IMOD is generally square or rectangular in shape and attached to supports at or near the corners, on tethers 32. In FIG. 6C, the movable reflective layer 14 is generally square or rectangular in shape and suspended from a deformable layer 34, which may include a flexible metal. The deformable layer 34 can connect, directly or indirectly, to the substrate 20 around the perimeter of the movable reflective layer 14. These connections are herein referred to as support posts. The implementation shown in FIG. 6C has additional benefits deriving from the decoupling of the optical functions of the movable reflective layer 14 from its mechanical functions, which are carried out by the deformable layer 34. This decoupling allows the structural design and materials used for the reflective layer 14 and those used for the deformable layer 34 to be optimized independently of one another.

Figure 6D:
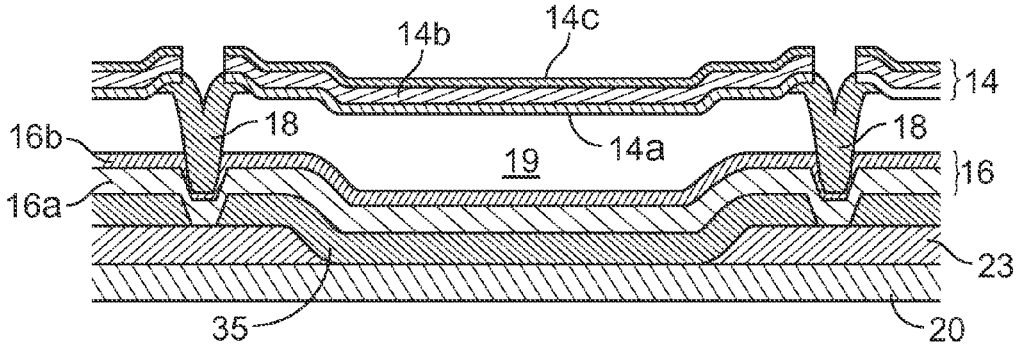

FIG. 6D shows another example of an IMOD, where the movable reflective layer 14 includes a reflective sub-layer 14*a*. The movable reflective layer 14 rests on a support structure, such as support posts 18. The support posts 18 provide separation of the movable reflective layer 14 from the lower stationary electrode (i.e., part of the optical stack 16 in the illustrated IMOD) so that a gap 19 is formed between the movable reflective layer 14 and the optical stack 16, for example when the movable reflective layer 14 is in a relaxed position. The movable reflective layer 14 also can include a conductive layer 14*c*, which may be configured to serve as an electrode, and a support layer 14*b*. In this example, the conductive layer 14*c* is disposed on one side of the support layer 14*b*, distal from the substrate 20, and the reflective sub-layer 14*a* is disposed on the other side of the support layer 14*b*, proximal to the substrate 20. In some implementations, the reflective sub-layer 14*a* can be conductive and can be disposed between the support layer 14*b* and the optical stack 16. The support layer 14*b* can include one or more layers of a dielectric material, for example, silicon oxynitride (SiON) or silicon dioxide ($SiO_2$). In some implementations, the support layer 14*b* can be a stack of layers, such as, for example, a $SiO_2$/SiON/$SiO_2$ tri-layer stack. Either or both of the reflective sub-layer 14*a* and the conductive layer 14*c* can include, for example, an aluminum (Al) alloy with about 0.5% copper (Cu), or another reflective metallic material. Employing conductive layers 14*a*, 14*c* above and below the dielectric support layer 14*b* can balance stresses and provide enhanced conduction. In some implementations, the reflective sub-layer 14*a* and the conductive layer 14*c* can be formed of different materials for a variety of design purposes, such as achieving specific stress profiles within the movable reflective layer 14.

As illustrated in FIG. 6D, some implementations also can include a black mask structure 23. The black mask structure 23 can be formed in optically inactive regions (such as between pixels or under posts 18) to absorb ambient or stray light. The black mask structure 23 also can improve the optical properties of a display device by inhibiting light from being reflected from or transmitted through inactive portions of the display, thereby increasing the contrast ratio. Additionally, the black mask structure 23 can be conductive and be configured to function as an electrical bussing layer. In some implementations, the row electrodes can be connected to the black mask structure 23 to reduce the resistance of the connected row electrode. The black mask structure 23 can be formed using a variety of methods, including deposition and patterning techniques. The black mask structure 23 can include one or more layers. For example, in some implementations, the black mask structure 23 includes a molybdenum-chromium (MoCr) layer that serves as an optical absorber, a layer, and an aluminum alloy that serves as a reflector and a bussing layer, with a thickness in the range of about 30-80 Å, 500-1000 Å, and 500-6000 Å, respectively. The one or more layers can be patterned using a variety of techniques, including photolithography and dry etching, including, for example, carbon tetrafluoromethane ($CF_4$) and/or oxygen ($O_2$) for the MoCr and $SiO_2$ layers and chlorine ($Cl_2$) and/or boron trichloride ($BCl_3$) for the aluminum alloy layer. In some implementations, the black mask 23 can be an etalon or interferometric stack structure. In such interferometric stack black mask structures 23, the conductive absorbers can be used to transmit or bus signals between lower, stationary electrodes in the optical stack 16 of each row or column. In some implementations, a spacer layer 35 can serve to generally electrically isolate the absorber layer 16*a* from the conductive layers in the black mask 23.

Figure 6E:
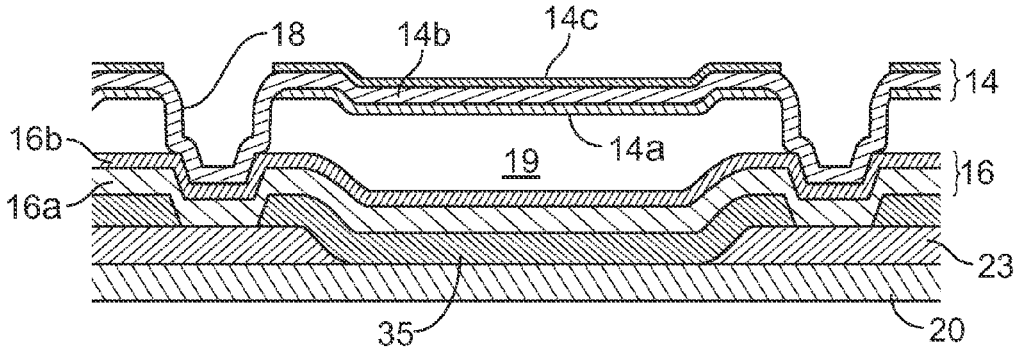

FIG. 6E shows another example of an IMOD, where the movable reflective layer 14 is self supporting. In contrast with FIG. 6D, the implementation of FIG. 6E does not include support posts 18. Instead, the movable reflective layer 14 contacts the underlying optical stack 16 at multiple locations, and the curvature of the movable reflective layer 14 provides sufficient support that the movable reflective layer 14 returns to the unactuated position of FIG. 6E when the voltage across the interferometric modulator is insufficient to cause actuation. The optical stack 16, which may contain a plurality of several different layers, is shown here for clarity including an optical absorber 16*a*, and a dielectric 16*b*. In some implementations, the optical absorber 16*a* may serve both as a fixed electrode and as a partially reflective layer. In some implementations, the optical absorber 16*a* is an order of magnitude (ten times or more) thinner than the movable reflective layer 14. In some implementations, optical absorber 16*a* is thinner than reflective sub-layer 14*a*.

In implementations such as those shown in FIGS. 6A-6E, the IMODs function as direct-view devices, in which images are viewed from the front side of the transparent substrate 20, i.e., the side opposite to that upon which the modulator is arranged. In these implementations, the back portions of the device (that is, any portion of the display device behind the movable reflective layer 14, including, for example, the deformable layer 34 illustrated in FIG. 6C) can be configured and operated upon without impacting or negatively affecting the image quality of the display device, because the reflective layer 14 optically shields those portions of the device. For example, in some implementations a bus structure (not illustrated) can be included behind the movable reflective layer 14 which provides the ability to separate the optical properties of the modulator from the electromechanical properties of the modulator, such as voltage addressing and the movements that result from such addressing. Additionally, the implementations of FIGS. 6A-6E can simplify processing, such as, for example, patterning.

Figure 7:
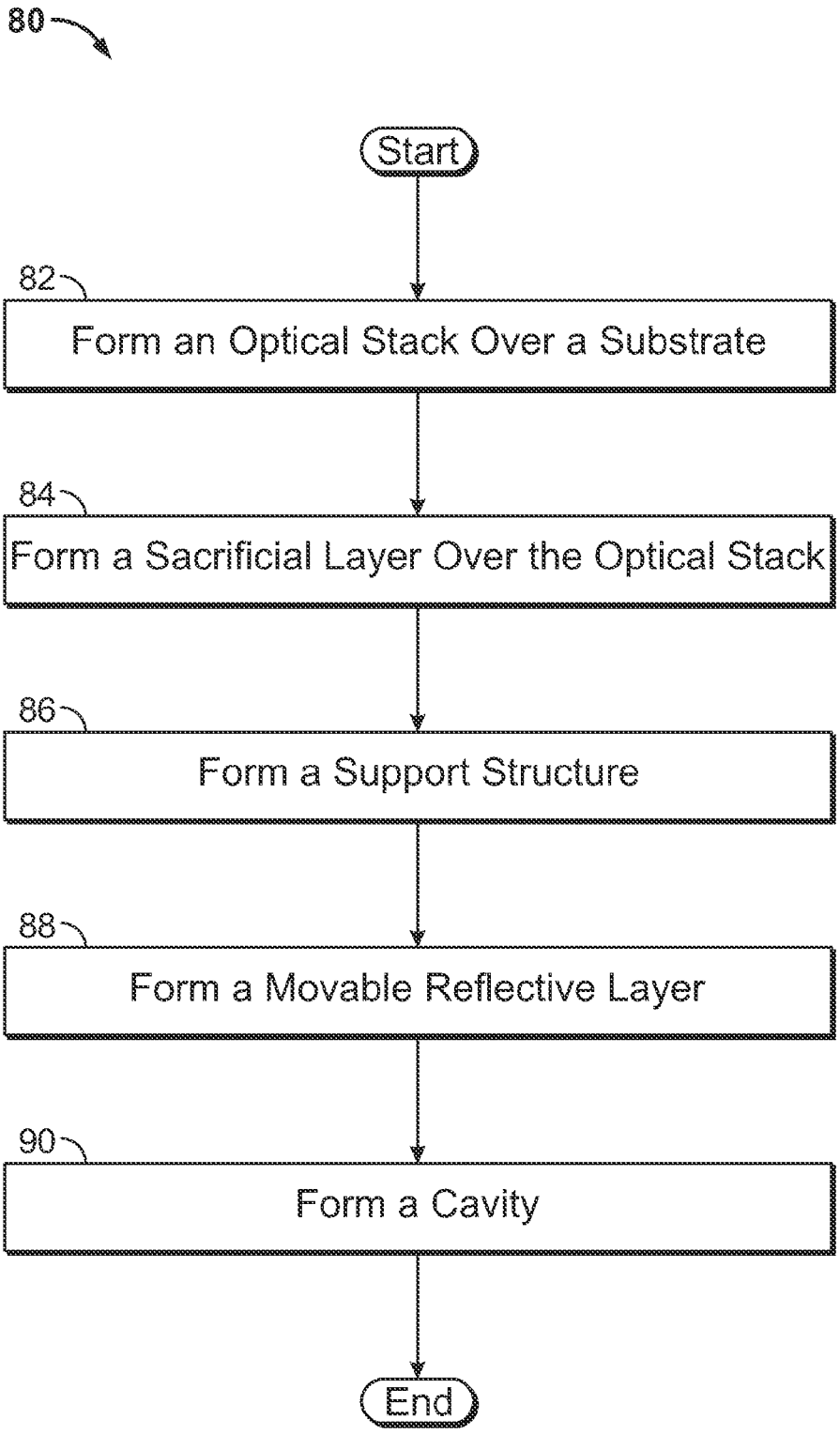
FIG. 7 shows an example of a flow diagram illustrating a manufacturing process for an interferometric modulator.
Figure 8A:
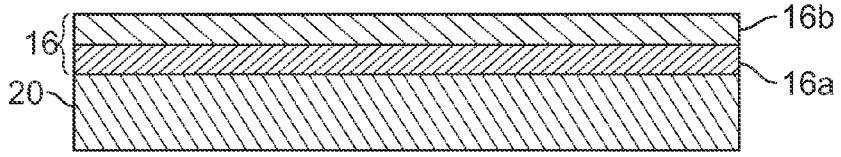
FIGS. 8A-8E show examples of cross-sectional schematic illustrations of various stages in a method of making an interferometric modulator.

FIG. 7 shows an example of a flow diagram illustrating a manufacturing process 80 for an interferometric modulator, and FIGS. 8A-8E show examples of cross-sectional schematic illustrations of corresponding stages of such a manufacturing process 80. In some implementations, the manufacturing process 80 can be implemented to manufacture an electromechanical systems device such as interferometric modulators of the general type illustrated in FIGS. 1 and 6. The manufacture of an electromechanical systems device can also include other blocks not shown in FIG. 7. With reference to FIGS. 1, 6 and 7, the process 80 begins at block 82 with the formation of the optical stack 16 over the substrate 20. FIG. 8A illustrates such an optical stack 16 formed over the substrate 20. The substrate 20 may be a transparent substrate such as glass or plastic, it may be flexible or relatively stiff and unbending, and may have been subjected to prior preparation processes, such as cleaning, to facilitate efficient formation of the optical stack 16. As discussed above, the optical stack 16 can be electrically conductive, partially transparent and partially reflective and may be fabricated, for example, by depositing one or more layers having the desired properties onto the transparent substrate 20. In FIG. 8A, the optical stack 16 includes a multilayer structure having sub-layers 16*a* and 16*b*, although more or fewer sub-layers may be included in some other implementations. In some implementations, one of the sub-layers 16*a*, 16*b* can be configured with both optically absorptive and electrically conductive properties, such as the combined conductor/absorber sub-layer 16*a*. Additionally, one or more of the sub-layers 16*a*, 16*b* can be patterned into parallel strips, and may form row electrodes in a display device. Such patterning can be performed by a masking and etching process or another suitable process known in the art. In some implementations, one of the sub-layers 16*a*, 16*b* can be an insulating or dielectric layer, such as sub-layer 16*b* that is deposited over one or more metal layers (e.g., one or more reflective and/or conductive layers). In addition, the optical stack 16 can be patterned into individual and parallel strips that form the rows of the display. It is noted that FIGS. 8A-8E may not be drawn to scale. For example, in some implementations, one of the sub-layers of the optical stack, the optically absorptive layer, may be very thin, although sub-layers 16*a*, 16*b* are shown somewhat thick in FIGS. 8A-8E.

Figure 8B:
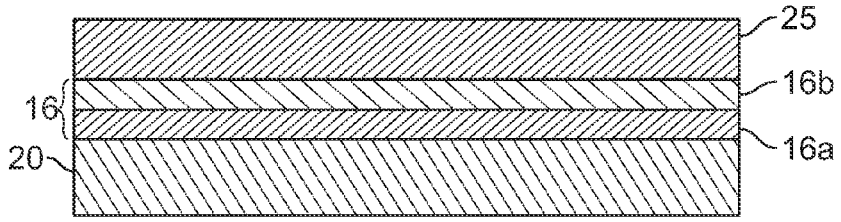

The process 80 continues at block 84 with the formation of a sacrificial layer 25 over the optical stack 16. The sacrificial layer 25 is later removed (see block 90) to form the cavity 19 and thus the sacrificial layer 25 is not shown in the resulting interferometric modulators 12 illustrated in FIG. 1. FIG. 8B illustrates a partially fabricated device including a sacrificial layer 25 formed over the optical stack 16. The formation of the sacrificial layer 25 over the optical stack 16 may include deposition of a xenon difluoride ($XeF_2$)-etchable material such as molybdenum (Mo) or amorphous silicon (a-Si), in a thickness selected to provide, after subsequent removal, a gap or cavity 19 (see also FIGS. 1 and 8E) having a desired design size. Deposition of the sacrificial material may be carried out using deposition techniques such as physical vapor deposition (PVD, which includes many different techniques, such as sputtering), plasma-enhanced chemical vapor deposition (PECVD), thermal chemical vapor deposition (thermal CVD), or spin-coating.

Figure 8C:
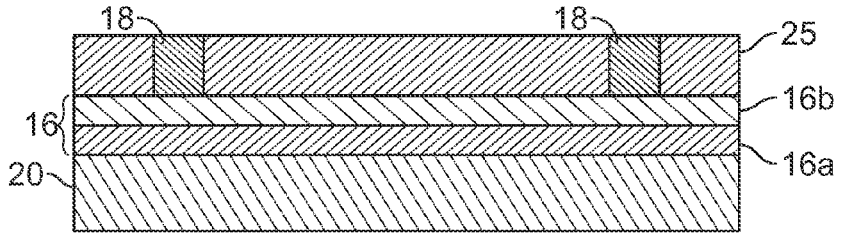

The process 80 continues at block 86 with the formation of a support structure such as post 18, illustrated in FIGS. 1, 6 and 8C. The formation of the post 18 may include patterning the sacrificial layer 25 to form a support structure aperture, then depositing a material (such as a polymer or an inorganic material such as silicon oxide) into the aperture to form the post 18, using a deposition method such as PVD, PECVD, thermal CVD, or spin-coating. In some implementations, the support structure aperture formed in the sacrificial layer can extend through both the sacrificial layer 25 and the optical stack 16 to the underlying substrate 20, so that the lower end of the post 18 contacts the substrate 20 as illustrated in FIG. 6A. Alternatively, as depicted in FIG. 8C, the aperture formed in the sacrificial layer 25 can extend through the sacrificial layer 25, but not through the optical stack 16. For example, FIG. 8E illustrates the lower ends of the support posts 18 in contact with an upper surface of the optical stack 16. The post 18, or other support structures, may be formed by depositing a layer of support structure material over the sacrificial layer 25 and patterning portions of the support structure material located away from apertures in the sacrificial layer 25. The support structures may be located within the apertures, as illustrated in FIG. 8C, but also can, at least partially, extend over a portion of the sacrificial layer 25. As noted above, the patterning of the sacrificial layer 25 and/or the support posts 18 can be performed by a patterning and etching process, but also may be performed by alternative etching methods.

Figure 8D:
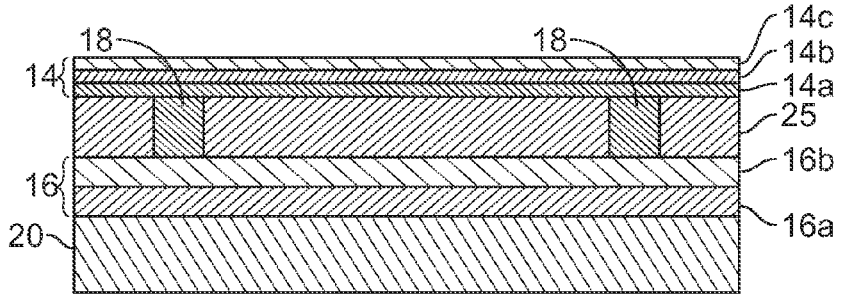
Figure 8E:
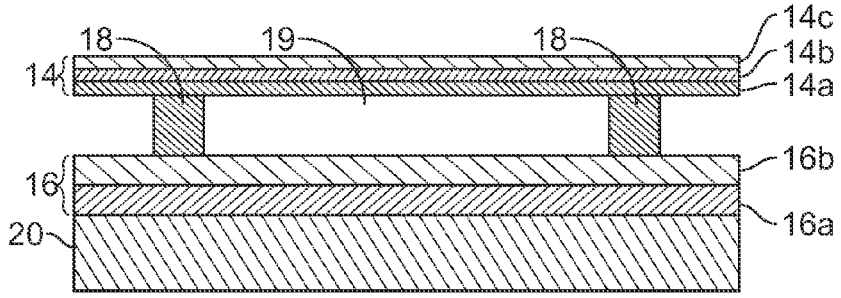

The process 80 continues at block 88 with the formation of a movable reflective layer or membrane such as the movable reflective layer 14 illustrated in FIGS. 1, 6 and 8D. The movable reflective layer 14 may be formed by employing one or more deposition steps including, for example, reflective layer (such as aluminum, aluminum alloy, or other reflective layer) deposition, along with one or more patterning, masking, and/or etching steps. The movable reflective layer 14 can be electrically conductive, and referred to as an electrically conductive layer. In some implementations, the movable reflective layer 14 may include a plurality of sub-layers 14*a*, 14*b*, 14*c* as shown in FIG. 8D. In some implementations, one or more of the sub-layers, such as sub-layers 14*a*, 14*c*, may include highly reflective sub-layers selected for their optical properties, and another sub-layer 14*b* may include a mechanical sub-layer selected for its mechanical properties. Since the sacrificial layer 25 is still present in the partially fabricated interferometric modulator formed at block 88, the movable reflective layer 14 is typically not movable at this stage. A partially fabricated IMOD that contains a sacrificial layer 25 may also be referred to herein as an "unreleased" IMOD. As described above in connection with FIG. 1, the movable reflective layer 14 can be patterned into individual and parallel strips that form the columns of the display.

The process 80 continues at block 90 with the formation of a cavity, such as cavity 19 illustrated in FIGS. 1, 6 and 8E. The cavity 19 may be formed by exposing the sacrificial material 25 (deposited at block 84) to an etchant. For example, an etchable sacrificial material such as Mo or amorphous S1 may be removed by dry chemical etching, by exposing the sacrificial layer 25 to a gaseous or vaporous etchant, such as vapors derived from solid $XeF_2$, for a period of time that is effective to remove the desired amount of material. The sacrificial material is typically selectively removed relative to the structures surrounding the cavity 19. Other etching methods, such as wet etching and/or plasma etching, also may be used. Since the sacrificial layer 25 is removed during block 90, the movable reflective layer 14 is typically movable after this stage. After removal of the sacrificial material 25, the resulting fully or partially fabricated IMOD may be referred to herein as a "released" IMOD.

Figure 9:
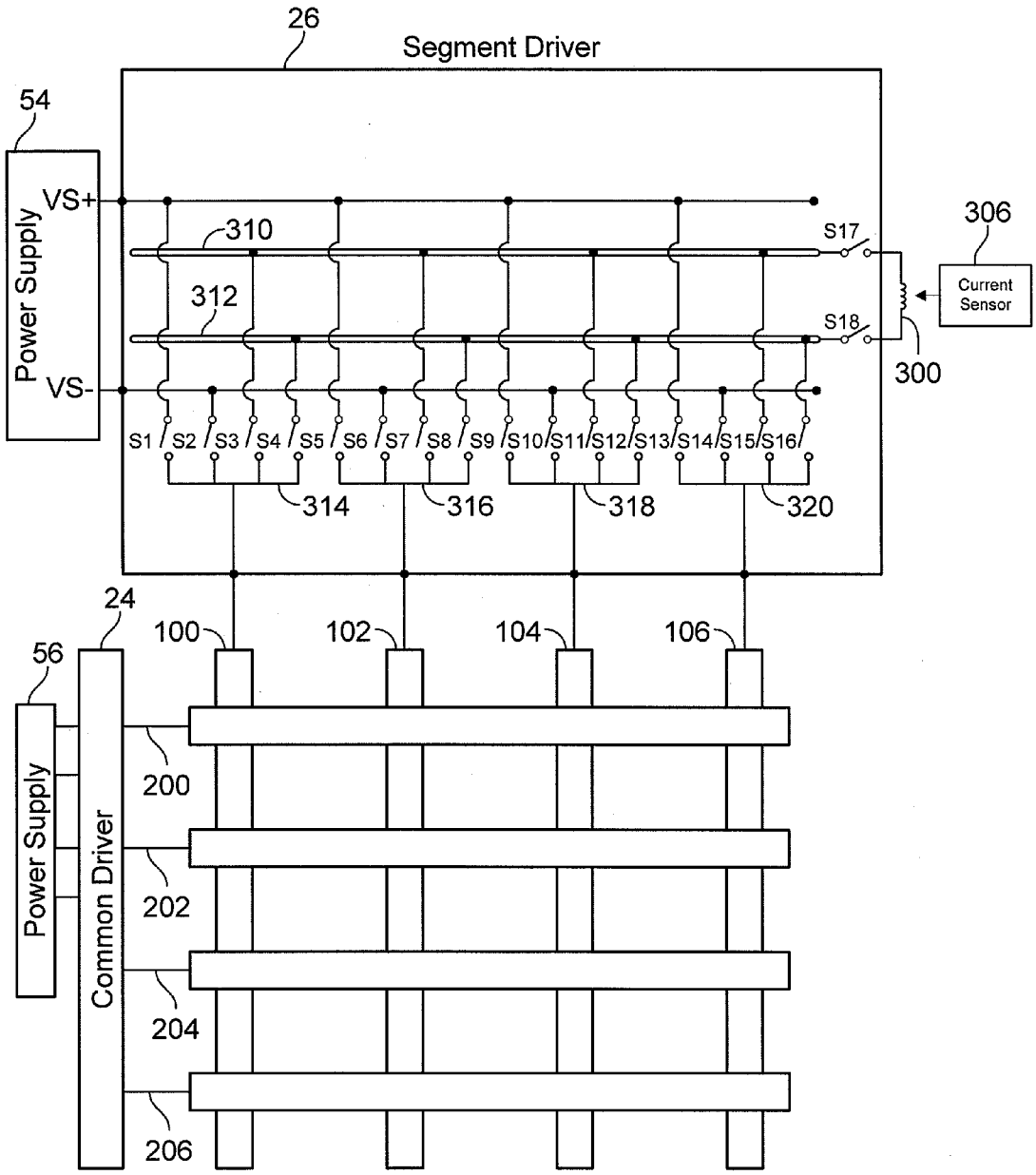
FIG. 9 shows a circuit for driving a display device according to some implementations.

One implementation of a driving circuit for driving a display, for example a passive matrix display similar to the IMOD displays discussed above or other passive matrix displays, will now be described in greater detail with reference to FIG. 9. FIG. 9 shows a circuit for driving a display device according to some implementations. As previously discussed, the circuit includes a common driver 24 and a segment driver 26. The segment driver 26 is configured to drive segment lines 100, 102, 104 and 106. The common driver 24 is configured to drive rows 200, 202, 204, 206 of the display. The segment driver 26 receives power from a power supply 54. The power supply 54 is configured to provide a positive voltage VS+ and a negative voltage VS− for driving the segment lines 100, 102, 104, and 106. The segment driver 26 also includes a first switching rail 310 and a second switching rail 312.

Each of the segment lines 100, 102, 104, and 106 are connected to a switching circuit 314, 316, 318, and 320 respectively. Each of the switching circuits 314, 316, 318, and 320 includes four switches for selectively connecting segment lines 100, 102, 104, and 106 to a positive voltage VS+, a negative voltage VS−, the first switching rail 310, and the second switching rail 312. For example, switching circuit 314 includes switches S1-S4. Likewise, switching circuit 316 includes switches S5-S8, switching circuit 318 includes switches S9-S12, and switching circuit 320 includes switches S13-S16.

The first switching rail 310 is also connected to a first end of an inductor 300 through switch S17. Similarly, the second switching rail 312 is connected to the second end of the inductor 300 through switch S18. The inductor 300 may have an inductance of approximately 10 μH, but is not limited thereto. For example, the inductor 300 may have an inductance within a range of between about 5 μH to about 15 μH, but is not limited thereto. Each of switches S1-S18 may be provided as a single pole switch, and may be provided as a transistor implemented switch, or the like. The transistor can be a thin film transistor (TFT) or metal-oxide-semiconductor field effect transistor (MOSFET). The switches S1-S18, may have an effective resistance of approximately 1Ω, but is not limited thereto. For example, the switches S1-S18 may have an effective resistance of between about 0.5Ω to about 3Ω.

Figure 10A:
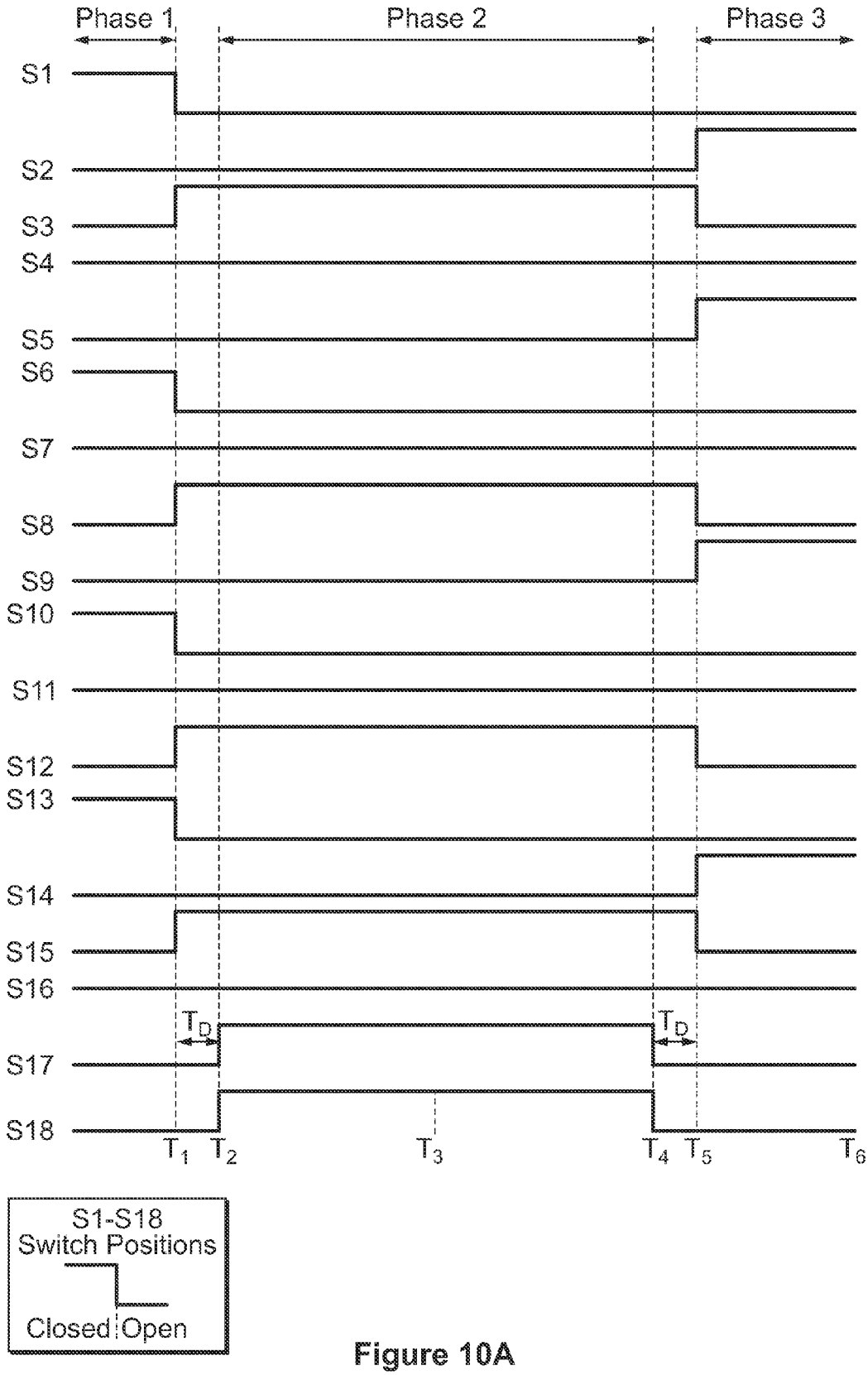
FIGS. 10A shows a timing diagram for the operation of switches S1-S18 of the circuit in FIG. 9 according to some implementations.
Figure 10B:
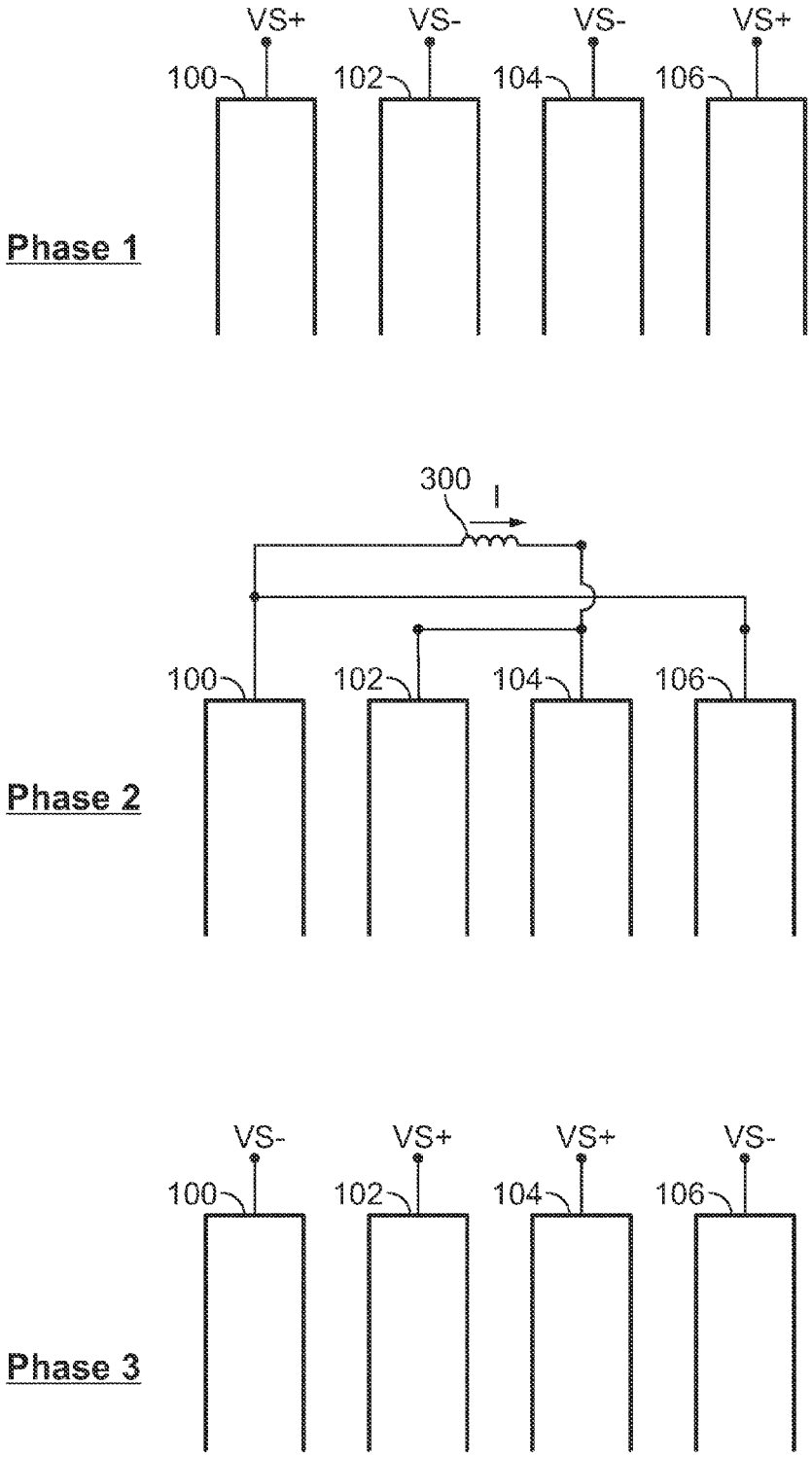
FIG. 10B shows a simplified view of the connections for each segment line in different phases of operating the driving circuit of FIG. 9 according to some implementations.
Figure 10C:
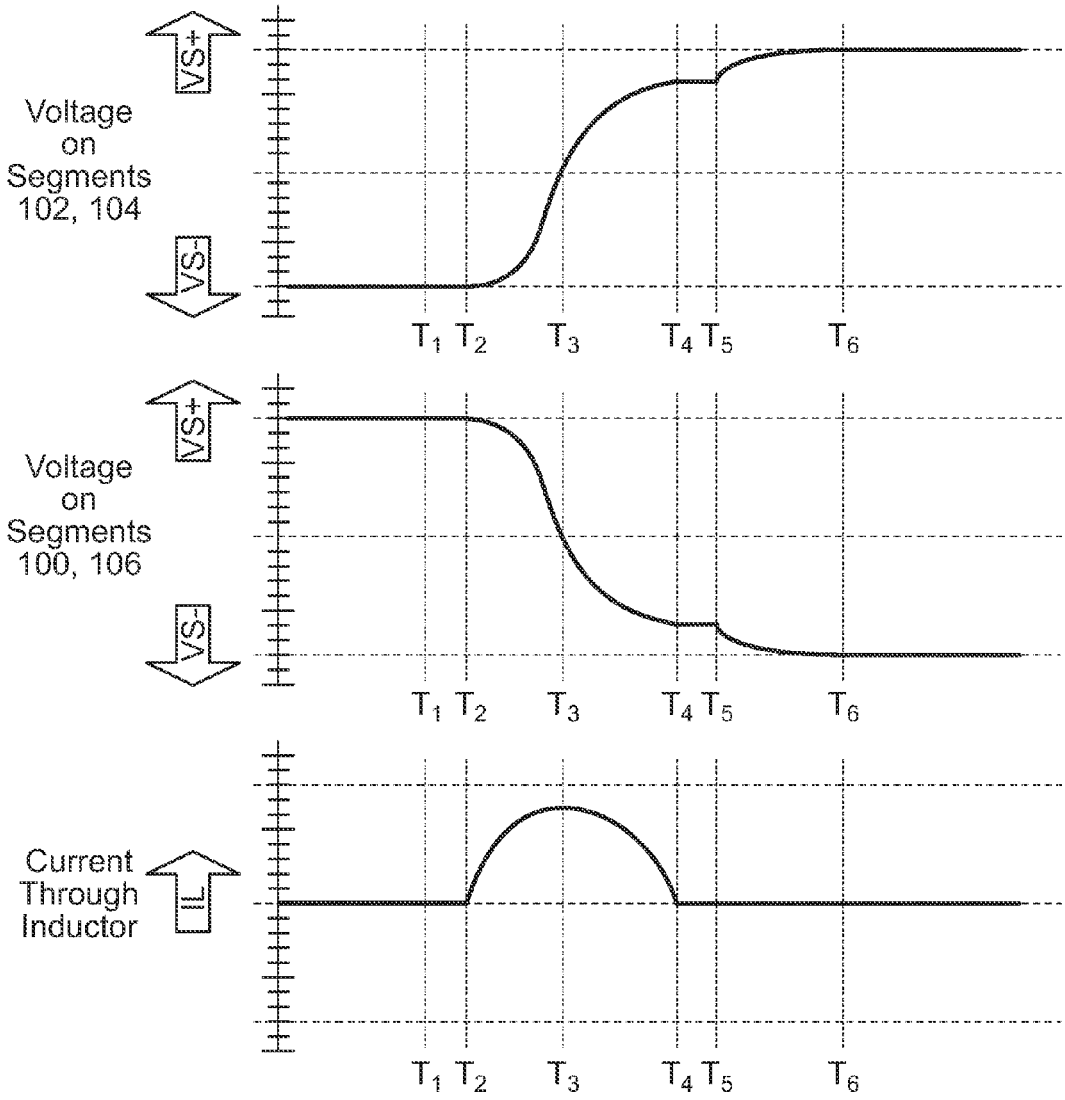
FIG. 10C shows graphs illustrating the voltages in each segment line and a current through the inductor according to some implementations.

Although switching circuits 314, 316, 318, and 320, and switches S17 and S18 are illustrated as separate switching elements, one having ordinary skill in the art will recognize that the configuration is not limited thereto. For example, each of switches S1-S18 may be provided in a single switching circuit which is configured to provide switches S1-S18 as illustrated in FIG. 9. Furthermore, the number of segment lines, switches, and rows is not limited to those illustrated. Rather, a person having ordinary skill in the art will recognize that the circuit of FIG. 9 represents a simplified configuration of a display driving circuit which may have hundreds or thousands of segment lines and common lines with a display element at each intersection thereof The operation of the driving circuit illustrated in FIG. 9 will now be described in greater detail with reference to FIGS. 10A-10C. FIG. 10A shows a timing diagram for the operation of switches S1-S18 of the circuit in FIG. 9 according to some implementations. In FIG. 10A, a high state of the switches S1-S18 corresponds to a closed position of the corresponding switch, while a low state of the switches S1-S18 correspond to an open position of the corresponding switch. FIG. 10B shows a simplified view of the connections for each segment line in different phases of operating the driving circuit of FIG. 9 according to some implementations. FIG. 10C shows graphs illustrating the voltages in each segment line and a current through the inductor according to some implementations.

FIGS. 10A-10C show the operation of the various switches and components of the circuit of FIG. 9 for an example in which two segment lines are switched from VS+ to VS−, and another two segment lines are switched from VS− to VS+. For example, with reference to FIG. 10B, phase 1 of driving the segments includes connecting segment lines 100 and 106 to positive voltage VS+, while segment lines 102 and 104 are connected to negative voltage VS−. As illustrated in FIG. 10A, switches S1, S6, S10, and S13 are set to a closed position (for example, by switching transistors on) in order to connect the segment lines to the respective voltages provided by the power supply 54. With returned reference to FIG. 9, switches S1 and S13 are configured to connect segment lines 100 and 106 to a positive voltage terminal VS+ of the power supply 54. Switches S6 and S10 are configured to connect segment lines 102 and 104 to a negative voltage terminal VS− of the power supply 54.

At a first time, T1, the polarities of segment lines 100, 102, 104, and 106 are triggered to be switched by the segment driver 26. The polarity switch may be initiated in order to reduce a build up of charge in the components of the display as discussed above. With reference to FIG. 10A, at T1, switches S1, S6, S10, and S13 are set to an open position (for example, by switching transistors off), thereby disconnecting the segment lines from the respective power supply terminals. Concurrently, switches S3, S8, S12, and S15 are set to a closed position, thereby connecting the segment lines 100, 102, 104, and 106 to the first or second switching rail. As illustrated in FIG. 9, switches S3 and S15 are configured to connect segment lines 100 and 106, respectively, to first switching rail 310. Switches S8 and S12 are configured to connect segment lines 102 and 104, respectively, to second switching rail 312.

Following the operation at T1, the segment driver 26 is configured to connect the switching rails 310 and 312 to the inductor 300 during a second phase, phase 2, of the polarity switching operation. As illustrated in FIG. 10A, switches S17 and S18 are set to a closed position at T2. T2 may be provided at a predetermined delay time $T_D$ from T1 in order to provide a sufficient amount of time to first connect the segment lines 100, 102, 104, and 106 to the switching rails 310 and 312. For example, $T_D$ may be set to a time of approximately 1 μs, but is not limited thereto. For example, the delay time $T_D$ may correspond to a time having a value between about 0.5 μs and 1.5 μs but is not limited thereto. The delay time $T_D$ may correspond to the switching response speed of the switches S1-S18 of the circuit.

With reference to FIG. 10B, the effective connections of the segment lines 100, 102, 104, 106 and the inductor 300 in phase 2 are illustrated. As illustrated in FIG. 10B, segment lines 100 and 106 are connected to a first end of the inductor 300. Segment lines 102 and 104 are connected to the second end of the inductor 300. As a result, a current I flows through inductor 300. With reference to FIG. 10C, a voltage at the first end of the inductor initially corresponds to VS+, and a voltage at the second end of the inductor initially corresponds to VS− at time T2. The current $I_L$ through the inductor increases from time T2 to time T3 while the voltage of segment lines 100 and 104 is greater than the voltage on segment lines 102 and 106. The rate of change of the current $I_L$ is equal to the voltage difference across the inductor 300. As the charge from segment lines 100 and 106 moves to segment lines 102 and 104, this voltage difference drops until at time T3 the voltage on all four segment lines is zero.

After T3, as current continues to flow through the inductor, the voltage on segment lines 100 and 106 goes negative and the voltage on segment lines 102 and 104 goes positive. This reversal in the polarity of the voltage across the inductor causes the current through the inductor to decrease after time T3 while charge continues to be transferred from segment lines 100 and 106 to segment lines 102 and 104.

As the current through the inductor reaches zero (0) (or substantially zero, such as close enough to zero to prevent an excessive voltage spike across the inductor and to achieve close to maximum charge transfer in the forward direction through the inductor) at time T4, the voltage on segment lines 100 and 106 (which was initially VS+) approaches VS−, and the voltage on segment lines 102 and 104 (which was initially VS−) approaches VS+. At this point, the segment driver 26 is configured to disconnect the segment lines 100, 102, 104, and 106 from the inductor 300. For example, the circuit may include a current sensor (not shown) for sensing a current through the inductor 300. When the current through the inductor reaches zero (0) or substantially zero, the current sensor may be configured to send a signal to the segment driver 26. In response, the segment driver is configured to disconnect the segment lines from the inductor, and connect the segment lines 100, 102, 104, and 106 to the new respective power source voltage terminals to continue the polarity switching operation.

For example, with reference to FIG. 10A, at time T4, the segment driver 26 is configured to open switches S17 and S18 in order to disconnect the segment lines 100, 102, 104, and 106 from the inductor 300. Following a time delay $T_D$, the segment driver 26 is configured to close switches S2, S5, S9, and S14 at time T4. With reference to FIG. 9, switches S2 and S14 are configured to connect segment lines 100 and 106, respectively, to voltage terminal VS−. Switches S5 and S9 are configured to connect segment lines 102 and 104, respectively, to voltage terminal VS+. As a result, the segment lines 100, 102, 104, and 106 can fully reach the respective voltages following the polarity switch. The effective connections at this time, or phase 3, of the polarity switching operation are illustrated in FIG. 10B. As illustrated, segment lines 100 and 106 are connected to voltage VS+, while segment lines 102 and 104 are connected to voltage VS−.

As a result of this polarity switching operation, a charge of a segment line which is switched from a first polarity to a second polarity can be used to charge a segment line which is being switched to from a second polarity to the first polarity. With reference to FIG. 10C, the charging operation between times T3-T4 reuses energy which is stored in the segment lines of the display. As a result, the new energy which is introduced for performing the polarity switching operation corresponds to the period T5-T6, in which the segment lines are connected to the power supply 54. This energy corresponds to the amount of energy loss in the various system components when a polarity switch takes place.

In the example described above, the segment lines which are initially connected to the positive voltage VS+, segment lines 100 and 106, are switched to the first switching rail 310, while the segment lines which are initially connected to the negative voltage VS−, segment lines 102 and 104, are switched to the second switching rail 312. However, the operation of the segment driver 26 is not limited to this example. Alternatively, segment lines which are connected to the positive voltage VS+ may be switched to second switching rail 312, and segment lines which are connected to the negative voltage VS− may be switched to the first switching rail 310 by operation of the corresponding switches. In some implementations, the segment driver 26 may be configured to alternate which switching rail is used for the different polarity segment lines when the switches are closed at time T1. In a first operation, switching rail S17 may be connected to positive segment lines and switching rail S18 may be connected to negative segment lines at time T1. In the next operation, switching rail S17 may be connected to negative segment lines and switching rail S18 may be connected to positive segment lines at time T1. Furthermore, the segment driver may be configured to periodically switch the segment line having a voltage, positive or negative, which is connected to each of the switching rails 310 and 312 at time T1 in order to reduce a build up of charge in the switching rails 310 and 312.

The example described with reference to FIGS. 10A-10B corresponds to a symmetric, or balanced, polarity switching operation. That is, two segment lines 100, 106, are switched from the positive voltage VS+ to the negative voltage VS−, while two segment lines 100, 102, are switched from the negative voltage VS− to the positive voltage VS+. However, with a plurality of segment lines in a display device, the polarity switching operation may not always be symmetric.

Figure 11:
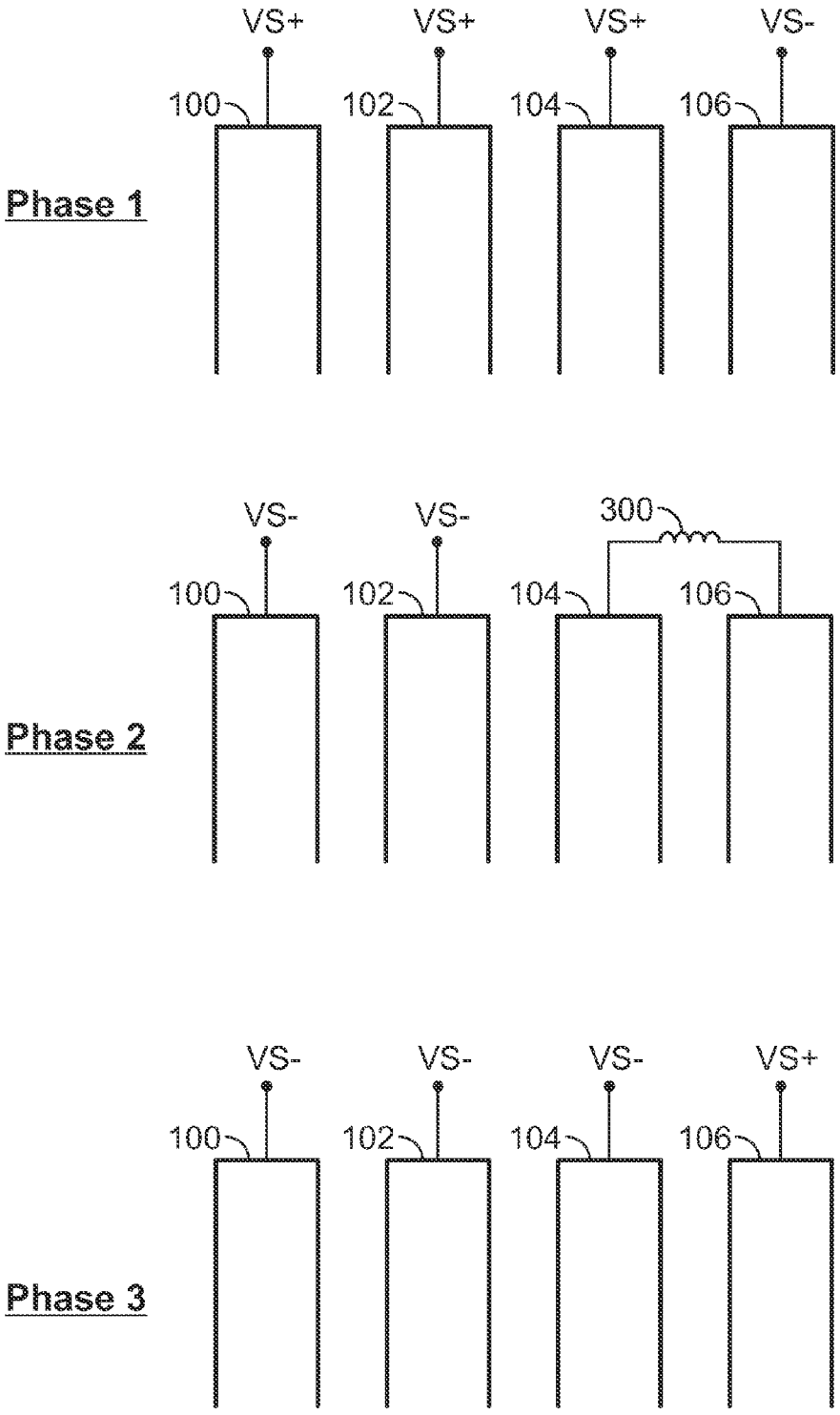
FIG. 11 shows a simplified view of the connection for each segment line in different phases of operating the driving circuit of FIG. 9 according to some implementations.

The operation of one implementation of a segment driver 26 in a non-symmetric polarity switching operation will be described with reference to FIG. 11. FIG. 11 shows a simplified view of the connection for each segment line in different phases of operating the driving circuit of FIG. 9 according to some implementations. As illustrated in FIG. 11, segment lines 100, 102, and 104 are initially connected to voltage VS+ in phase 1 of the polarity switching operation. Segment line 106 is initially connected to voltage VS− in phase 1. These connections can be established by closing switches S1, S5, S9, and S14 of circuit illustrated in FIG. 9.

In phase 2, only one of the segment lines 100, 102, and 104 is connected to a first end of the inductor 300. For example, segment line 104 is connected to a first end of the inductor 300 by closing switches S11 and S17, and opening switch S9. Segment line 106 is connected to the other end of inductor 300 by closing switches S16 and S18, and opening switch S14. Segment lines 100 and 102 are directly connected to VS−, by closing switches S2 and S6, and opening switches S1 and S5. In phase 3 of the polarity switching operation, switches S17 and S18 are set to an open position such that the first switching rail 310 and the second switching rail 312 are disconnected from the inductor 300. Subsequently, segment line 104 is connected to voltage VS− by closing switch S10 and opening switch S11, while segment line 106 is connected to voltage VS+ by closing switch S13 and opening switch S16. As a result, only segment lines 104 and 106 are configured to reuse energy during the polarity switching operation, while segment lines 100 and 102 are charged by connecting directly to power supply 54.

Figure 12:
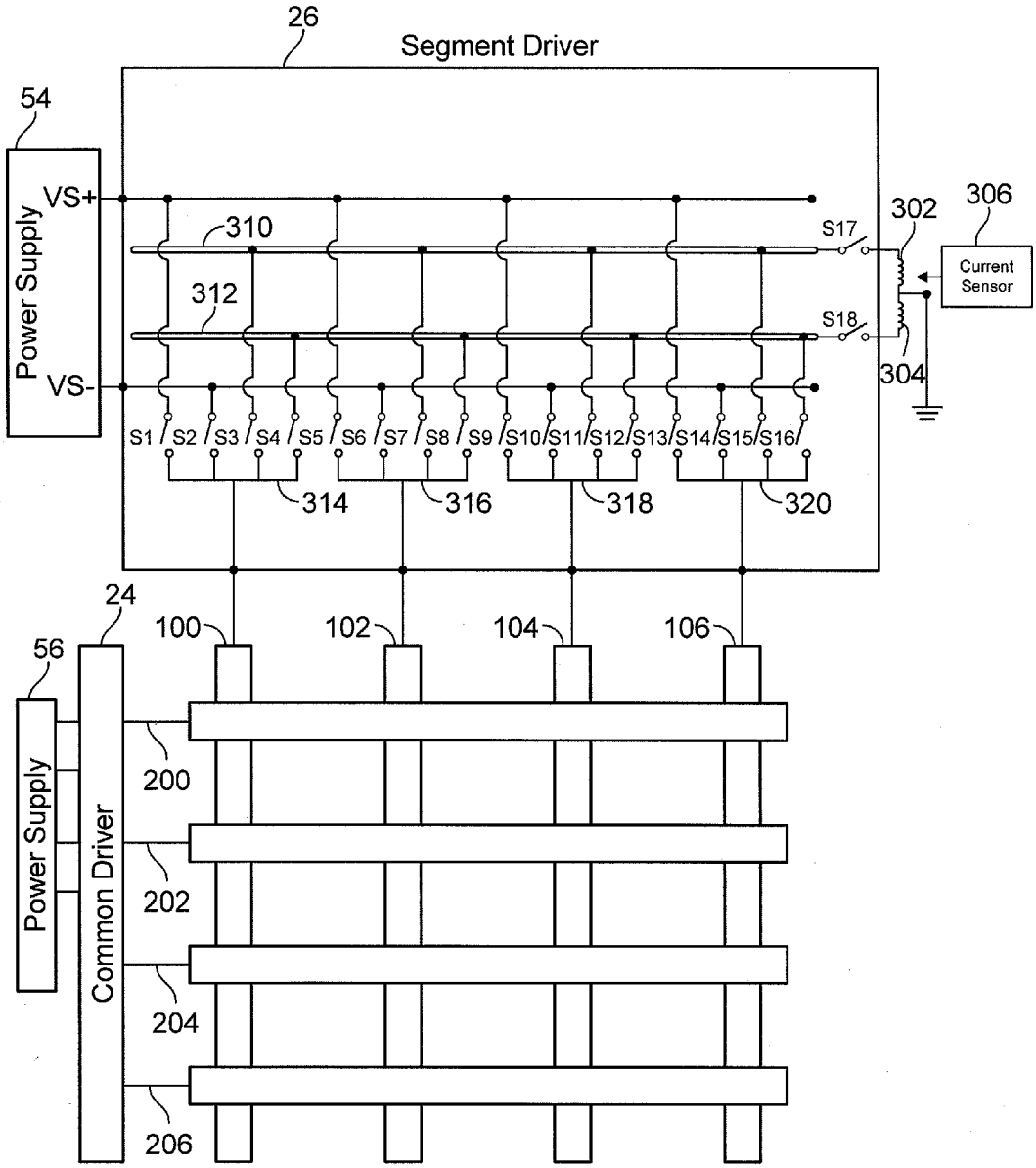
FIG. 12 shows a circuit for driving a display device according to some implementations.

Alternatively, the segment driver 26 may be configured with two inductors in order to provide an efficient polarity switching operation even when the segment lines being switched are not symmetric. FIG. 12 shows a circuit for driving a display device according to some implementations. The elements of FIG. 12 are similar to those previously described with respect to FIG. 9, and therefore a description of like elements will be omitted. The circuit of FIG. 12 includes a first inductor 302 and a second inductor 304 connected to the first and second switching rails 310 and 312. A first end of the first inductor 302 is connected to the first switching rail 310 through switch S17. The second end of the first inductor 302 is connected to ground. The second inductor 304 has a first end connected to the second switching rail 312 through switch S18, and a second end connected to ground.

Figure 13:
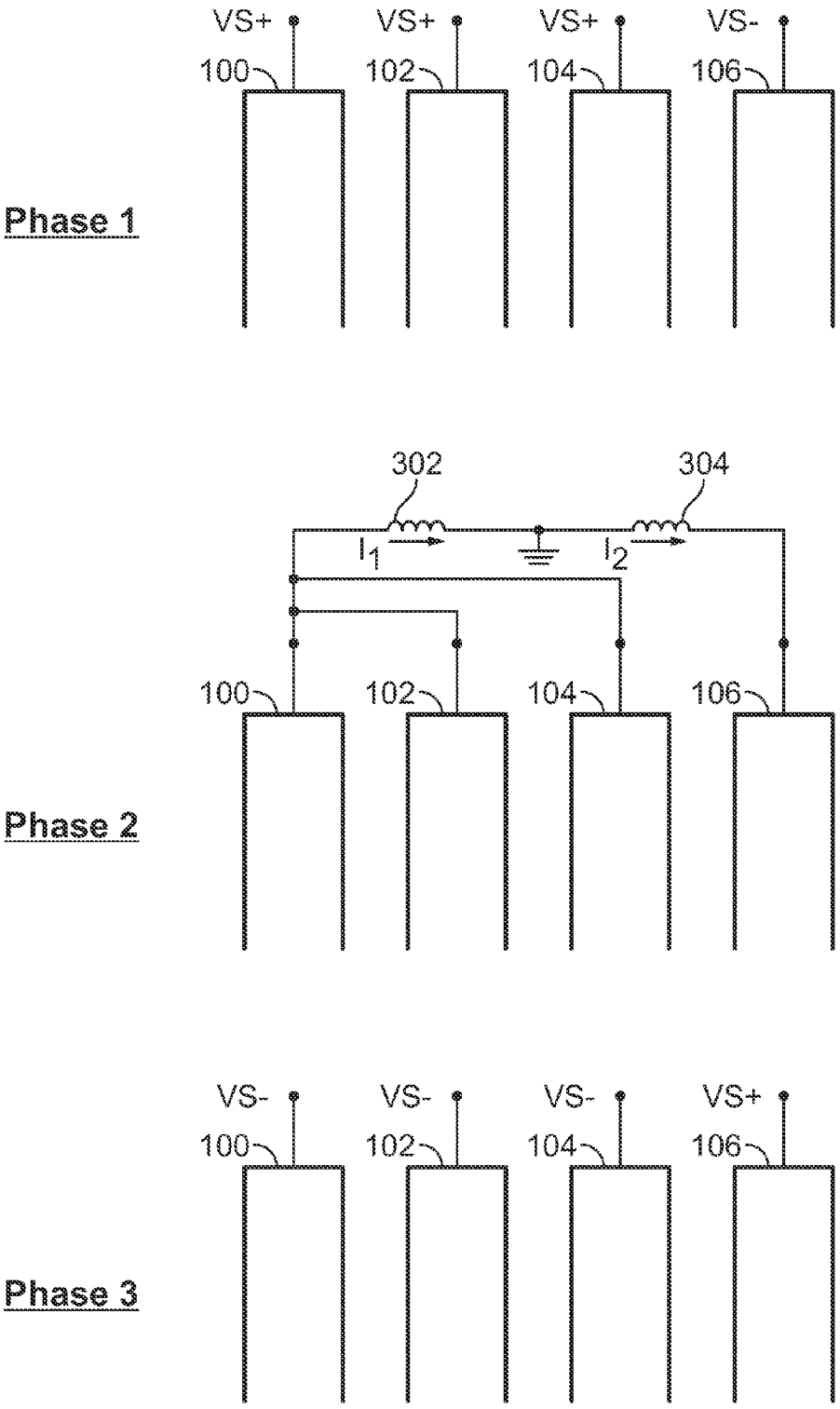
FIG. 13 shows a simplified view of the connections for each segment line in different phases of operating the driving circuit of FIG. 12 according to some implementations.

The operation of the circuit of FIG. 12 will be explained in greater detail with reference to FIG. 13. FIG. 13 shows a simplified view of the connections for each segment line in different phases of operating the driving circuit of FIG. 12 according to some implementations. As illustrated in FIG. 13, phase 1 of the polarity switching operation includes segment lines 100, 102, and 104 connected to voltage VS+. Segment line 106 is initially connected to VS−. These connections can be established by closing switches S1, S5, S9, and S14 of the circuit illustrated in FIG. 12.

In phase 2, each of segment lines 100, 102, and 104 is connected to a first end of the first inductor 302. These connections may be established by closing switches S3, S7, S11, and S17, and opening switches S1, S5, and S13. Segment line 106 is connected to the second end of the second inductor 304 by closing switches S16 and S18, and opening switch S14. As a result, a current I1 flows through the first inductor 302, and a current 12 flows through the second inductor 304. Since the configuration of FIG. 13 includes three segment lines which are discharged from a positive voltage VS+, the segment line, i.e. segment line 106, which is switched from the negative voltage VS− to the positive voltage VS+ may be charged entirely by reusing energy in the system. Meanwhile, excess current flowing through the first inductor 302 flows to the ground terminal.

In phase 3 of the polarity switching operation, switches S17 and S18 are set to an open position such that the first switching rail 310 and the second switching rail 312 are disconnected from the first inductor 302 and the second inductor 304. Subsequently, segment lines 100, 102, and 104 are connected to voltage VS− by closing switches S2, S6, and S10 and opening switches S3, S7, and S11. Segment lines 100, 102, and 104 are charged by the connection to the power supply 54 to the negative voltage VS−. Segment line 106, which is fully charged, is connected to voltage VS+ by closing switch S13 and opening switch S16. As a result, a charge of segment lines 100, 102, 104 may be efficiently used to charge segment line 106, and the total energy used in the system during a polarity switch may be reduced as compared to a system that does not recover energy in the display when switching polarity, for example, by using inductors.

Any number of inductors may be provided in the circuit to achieve a combined inductance corresponding to the inductors 300, 302, and 304. For example, a plurality of inductors may be provided in series to provide a combined inductance value. Inductors may also be provided in parallel through switching circuits in order to change or control the inductance based on the requirements of the circuit during a polarity switching operation.

Figure 14:
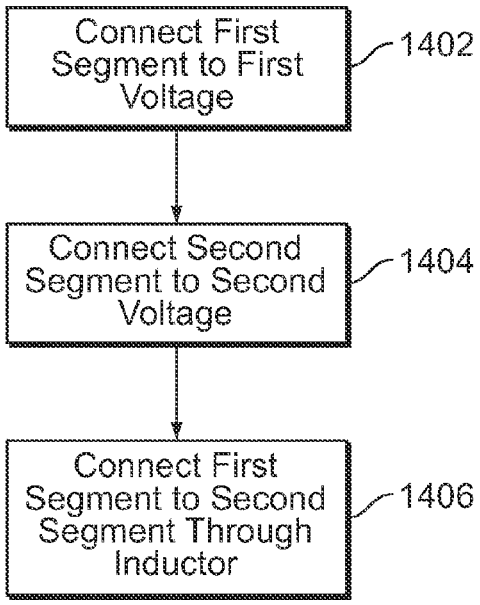
FIG. 14 shows a flowchart of a method of driving a display according to some implementations

A method of driving a display during a polarity switch will now be described with reference to FIG. 14. FIG. 14 shows a flowchart of a method of driving a display according to some implementations. At a block 1402 the method begins by connecting a first segment to a first voltage. The operation proceeds to a block 1404 where a second segment is connected to a second voltage. It is understood that the blocks 1402 and 1404 can be performed simultaneously, or the block 1404 may be performed before the block 1402. The first voltage may correspond to a first polarity, while the second voltage may correspond to a second polarity. At a block 1406 the first segment is connected to the second segment through an inductor. The inductor can include at least one inductor as described above for charging a segment line by inducing a voltage across the inductor corresponding to the current flowing through the inductor. As a result, the method may reuse energy in the system during a polarity switch operation.

Figure 15:
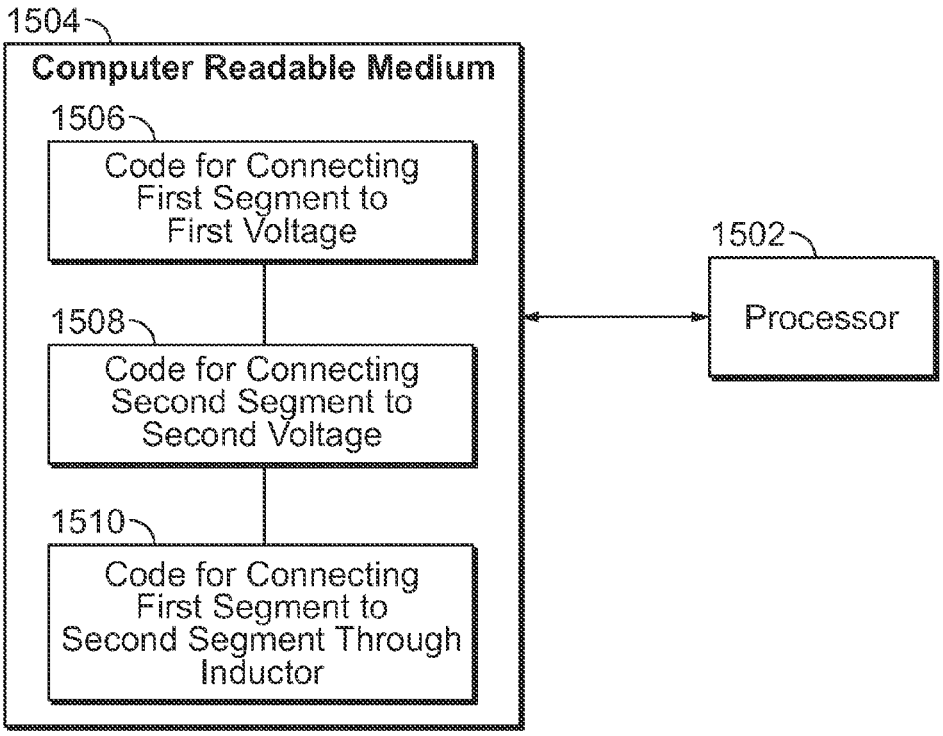
FIG. 15 shows a block diagram of a computer program product according to some implementations

The method may be implemented in the form of a computer program executed by a processor. FIG. 15 shows a block diagram of a computer program product according to some implementations. The computer program product includes a processor 1502 and a computer-readable medium 1504 coupled to the processor 1502. The computer-readable medium 1504 includes code for connecting a first segment to a first voltage 1506, code for connecting a second segment to a second voltage 1508, and code for connecting the first segment to the second segment through an inductor 1510. The processor may be configured to execute the code segments 1506, 1508, and 1510 which are stored in the computer-readable medium 1504.

Figure 16A:
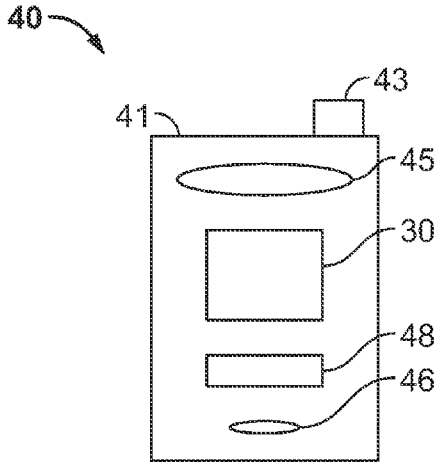
FIGS. 16A and 16B show examples of system block diagrams illustrating a display device that includes a plurality of interferometric modulators.
Figure 16B:
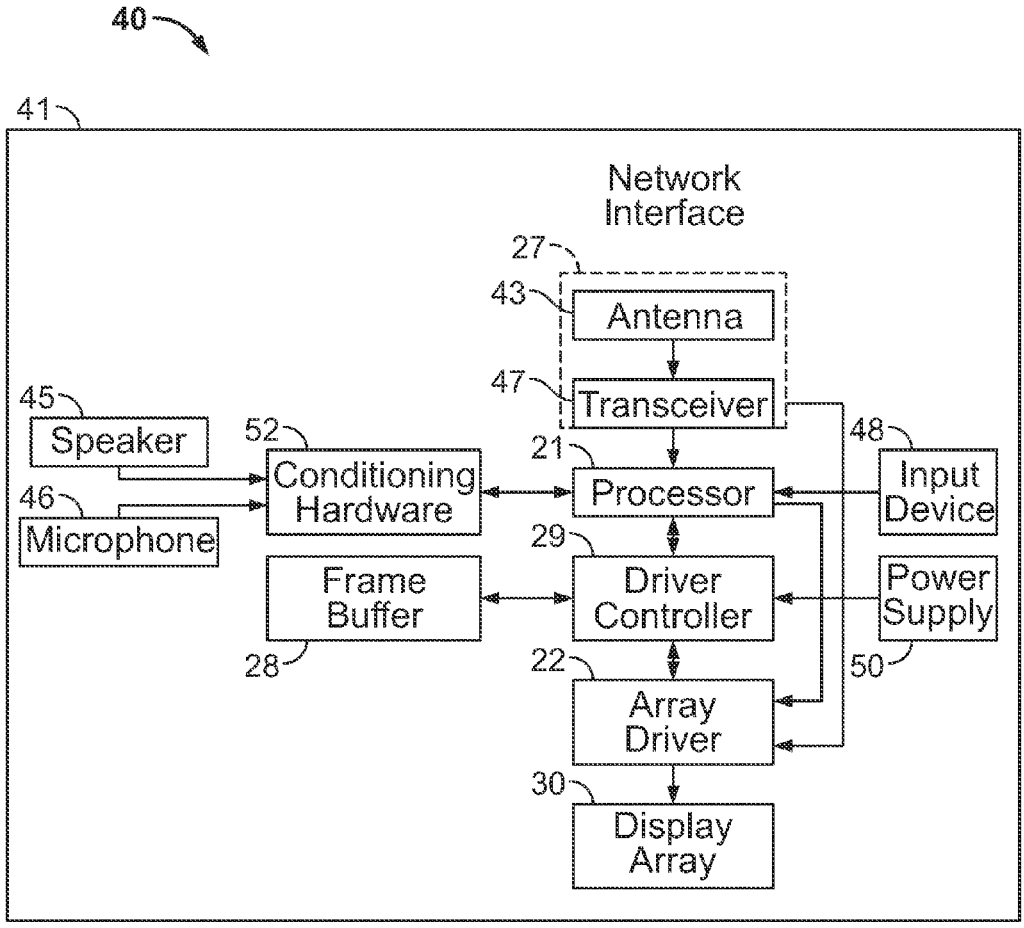

FIGS. 16A and 16B show examples of system block diagrams illustrating a display device 40 that includes a plurality of interferometric modulators. The display device 40 can be, for example, a smart phone, a cellular or mobile telephone. However, the same components of the display device 40 or slight variations thereof are also illustrative of various types of display devices such as televisions, tablets, e-readers, hand-held devices and portable media players.

The display device 40 includes a housing 41, a display 30, an antenna 43, a speaker 45, an input device 48 and a microphone 46. The housing 41 can be formed from any of a variety of manufacturing processes, including injection molding, and vacuum forming. In addition, the housing 41 may be made from any of a variety of materials, including, but not limited to: plastic, metal, glass, rubber and ceramic, or a combination thereof. The housing 41 can include removable portions (not shown) that may be interchanged with other removable portions of different color, or containing different logos, pictures, or symbols.

The display 30 may be any of a variety of displays, including a bi-stable or analog display, as described herein. The display 30 also can be configured to include a flat-panel display, such as plasma, EL, OLED, STN LCD, or TFT LCD, or a non-flat-panel display, such as a CRT or other tube device. In addition, the display 30 can include an interferometric modulator display, as described herein.

The components of the display device 40 are schematically illustrated in FIG. 16B. The display device 40 includes a housing 41 and can include additional components at least partially enclosed therein. For example, the display device 40 includes a network interface 27 that includes an antenna 43 which is coupled to a transceiver 47. The transceiver 47 is connected to a processor 21, which is connected to conditioning hardware 52. The conditioning hardware 52 may be configured to condition a signal (e.g., filter a signal). The conditioning hardware 52 is connected to a speaker 45 and a microphone 46. The processor 21 is also connected to an input device 48 and a driver controller 29. The driver controller 29 is coupled to a frame buffer 28, and to an array driver 22, which in turn is coupled to a display array 30. In some implementations, a power supply 50 can provide power to substantially all components in the particular display device 40 design.

The network interface 27 includes the antenna 43 and the transceiver 47 so that the display device 40 can communicate with one or more devices over a network. The network interface 27 also may have some processing capabilities to relieve, for example, data processing requirements of the processor 21. The antenna 43 can transmit and receive signals. In some implementations, the antenna 43 transmits and receives RF signals according to the IEEE 16.11 standard, including IEEE 16.11(a), (b), or (g), or the IEEE 802.11 standard, including IEEE 802.11a, b, g, n, and further implementations thereof. In some other implementations, the antenna 43 transmits and receives RF signals according to the BLUETOOTH standard. In the case of a cellular telephone, the antenna 43 is designed to receive code division multiple access (CDMA), frequency division multiple access (FDMA), time division multiple access (TDMA), Global System for Mobile communications (GSM), GSM/General Packet Radio Service (GPRS), Enhanced Data GSM Environment (EDGE), Terrestrial Trunked Radio (TETRA), Wideband-CDMA (W-CDMA), Evolution Data Optimized (EV-DO), 1xEV-DO, EV-DO Rev A, EV-DO Rev B, High Speed Packet Access (HSPA), High Speed Downlink Packet Access (HSDPA), High Speed Uplink Packet Access (HSUPA), Evolved High Speed Packet Access (HSPA+), Long Term Evolution (LTE), AMPS, or other known signals that are used to communicate within a wireless network, such as a system utilizing 3G or 4G technology. The transceiver 47 can pre-process the signals received from the antenna 43 so that they may be received by and further manipulated by the processor 21. The transceiver 47 also can process signals received from the processor 21 so that they may be transmitted from the display device 40 via the antenna 43.

In some implementations, the transceiver 47 can be replaced by a receiver. In addition, in some implementations, the network interface 27 can be replaced by an image source, which can store or generate image data to be sent to the processor 21. The processor 21 can control the overall operation of the display device 40. The processor 21 receives data, such as compressed image data from the network interface 27 or an image source, and processes the data into raw image data or into a format that is readily processed into raw image data. The processor 21 can send the processed data to the driver controller 29 or to the frame buffer 28 for storage. Raw data typically refers to the information that identifies the image characteristics at each location within an image. For example, such image characteristics can include color, saturation and gray-scale level.

The processor 21 can include a microcontroller, CPU, or logic unit to control operation of the display device 40. The conditioning hardware 52 may include amplifiers and filters for transmitting signals to the speaker 45, and for receiving signals from the microphone 46. The conditioning hardware 52 may be discrete components within the display device 40, or may be incorporated within the processor 21 or other components.

The driver controller 29 can take the raw image data generated by the processor 21 either directly from the processor 21 or from the frame buffer 28 and can re-format the raw image data appropriately for high speed transmission to the array driver 22. In some implementations, the driver controller 29 can re-format the raw image data into a data flow having a raster-like format, such that it has a time order suitable for scanning across the display array 30. Then the driver controller 29 sends the formatted information to the array driver 22. Although a driver controller 29, such as an LCD controller, is often associated with the system processor 21 as a stand-alone Integrated Circuit (IC), such controllers may be implemented in many ways. For example, controllers may be embedded in the processor 21 as hardware, embedded in the processor 21 as software, or fully integrated in hardware with the array driver 22.

The array driver 22 can receive the formatted information from the driver controller 29 and can re-format the video data into a parallel set of waveforms that are applied many times per second to the hundreds, and sometimes thousands (or more), of leads coming from the display's x-y matrix of pixels.

In some implementations, the driver controller 29, the array driver 22, and the display array 30 are appropriate for any of the types of displays described herein. For example, the driver controller 29 can be a conventional display controller or a bi-stable display controller (such as an IMOD controller). Additionally, the array driver 22 can be a conventional driver or a bi-stable display driver (such as an IMOD display driver). Moreover, the display array 30 can be a conventional display array or a bi-stable display array (such as a display including an array of IMODs). In some implementations, the driver controller 29 can be integrated with the array driver 22. Such an implementation can be useful in highly integrated systems, for example, mobile phones, portable-electronic devices, watches or small-area displays.

In some implementations, the input device 48 can be configured to allow, for example, a user to control the operation of the display device 40. The input device 48 can include a keypad, such as a QWERTY keyboard or a telephone keypad, a button, a switch, a rocker, a touch-sensitive screen, a touch-sensitive screen integrated with display array 30, or a pressure- or heat-sensitive membrane. The microphone 46 can be configured as an input device for the display device 40. In some implementations, voice commands through the microphone 46 can be used for controlling operations of the display device 40.

The power supply 50 can include a variety of energy storage devices. For example, the power supply 50 can be a rechargeable battery, such as a nickel-cadmium battery or a lithium-ion battery. In implementations using a rechargeable battery, the rechargeable battery may be chargeable using power coming from, for example, a wall socket or a photovoltaic device or array. Alternatively, the rechargeable battery can be wirelessly chargeable. The power supply 50 also can be a renewable energy source, a capacitor, or a solar cell, including a plastic solar cell or solar-cell paint. The power supply 50 also can be configured to receive power from a wall outlet.

In some implementations, control programmability resides in the driver controller 29 which can be located in several places in the electronic display system. In some other implementations, control programmability resides in the array driver 22. The above-described optimization may be implemented in any number of hardware and/or software components and in various configurations.

The various illustrative logics, logical blocks, modules, circuits and algorithm steps described in connection with the implementations disclosed herein may be implemented as electronic hardware, computer software, or combinations of both. The interchangeability of hardware and software has been described generally, in terms of functionality, and illustrated in the various illustrative components, blocks, modules, circuits and steps described above. Whether such functionality is implemented in hardware or software depends upon the particular application and design constraints imposed on the overall system.

The hardware and data processing apparatus used to implement the various illustrative logics, logical blocks, modules and circuits described in connection with the aspects disclosed herein may be implemented or performed with a general purpose single- or multi-chip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing devices, such as a combination of a DSP and a microprocessor, a plurality of microprocessors, one or more microprocessors in conjunction with a DSP core, or any other such configuration. In some implementations, particular steps and methods may be performed by circuitry that is specific to a given function.

In one or more aspects, the functions described may be implemented in hardware, digital electronic circuitry, computer software, firmware, including the structures disclosed in this specification and their structural equivalents thereof, or in any combination thereof. Implementations of the subject matter described in this specification also can be implemented as one or more computer programs, i.e., one or more modules of computer program instructions, encoded on a computer storage media for execution by, or to control the operation of, data processing apparatus.

If implemented in software, the functions may be stored on or transmitted over as one or more instructions or code on a computer-readable medium. The steps of a method or algorithm disclosed herein may be implemented in a processor-executable software module which may reside on a computer-readable medium. Computer-readable media includes both computer storage media and communication media including any medium that can be enabled to transfer a computer program from one place to another. A storage media may be any available media that may be accessed by a computer. By way of example, and not limitation, such computer-readable media may include RAM, ROM, EEPROM, CD-ROM or other optical disk storage, magnetic disk storage or other magnetic storage devices, or any other medium that may be used to store desired program code in the form of instructions or data structures and that may be accessed by a computer. Also, any connection can be properly termed a computer-readable medium. Disk and disc, as used herein, includes compact disc (CD), laser disc, optical disc, digital versatile disc (DVD), floppy disk, and Blu-ray disc where disks usually reproduce data magnetically, while discs reproduce data optically with lasers. Combinations of the above also may be included within the scope of computer-readable media. Additionally, the operations of a method or algorithm may reside as one or any combination or set of codes and instructions on a machine readable medium and computer-readable medium, which may be incorporated into a computer program product.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. The word "exemplary" is used exclusively herein to mean "serving as an example, instance, or illustration." Any implementation described herein as "exemplary" is not necessarily to be construed as preferred or advantageous over other possibilities or implementations. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of an IMOD as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, a person having ordinary skill in the art will readily recognize that such operations need not be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

What is claimed is:

1. A method of driving a display including a plurality of segment lines, comprising:

connecting at least one first segment line to a first voltage;

connecting at least one second segment line to a second voltage;

connecting the at least one first segment line to the at least one second segment line through at least one inductor;

transferring charge between the at least one first and the at least one second segment lines through the at least one inductor; and disconnecting the at least one first segment line and the at least one second segment line from the at least one inductor after a current in the at least one inductor rises and falls to substantially zero.

2. The method of claim 1, comprising:

connecting a first plurality of segment lines to the first voltage;

connecting a second plurality of segment lines to the second voltage; and connecting the first plurality of segment lines to the second plurality of segment lines through the at least one inductor.

3. The method of claim 1, wherein the first voltage corresponds to a first polarity, and the second voltage corresponds to a second polarity.

4. The method of claim 1, further comprising connecting the at least one first segment line to the second voltage and the at least one second segment line to the first voltage.

5. A circuit for driving a display, comprising:

a power supply;

a first segment line;

a second segment line;

at least one inductor;

a first switching circuit capable of selectively connecting the first segment line to one of the power supply and the at least one inductor;

a second switching circuit capable of selectively connecting the second segment line to one of the power supply and the at least one inductor; and a segment driver circuit capable of disconnecting the first and second segment lines from the at least one inductor after a current in the at least one inductor rises and falls to substantially zero.

6. The circuit of claim 5, wherein the power supply outputs a first voltage corresponding to a first polarity and a second voltage corresponding to a second polarity.

7. The circuit of claim 5, wherein the at least one inductor includes a first and a second inductor.

8. The circuit of claim 7, wherein the first inductor is connectable to the first segment line through a first switching rail and the second inductor is connectable to the second segment line through a second switching rail.

9. The circuit of claim 8, wherein an end of each of the first and second inductors is connected to ground.

10. The circuit of claim 5, further comprising a current sensor capable of sensing the current through the at least one inductor.

11. The circuit of claim 5, comprising a single inductor, and wherein a first end of the single inductor is connectable to the first segment line through a first switching rail, and a second end of the single inductor is connectable to the second segment line through a second switching rail.

12. The circuit of claim 5, further comprising:

at least one first switch capable of connecting the first segment line to a first power supply output;

at least one second switch capable of connecting the first segment line to a second power supply output;

at least one third switch capable of connecting the first segment line to a first switching rail;

at least one fourth switch capable of connecting the first segment line to a second switching rail;

at least one fifth switch capable of connecting the first switching rail to the at least one inductor; and at least one sixth switch capable of connecting the second switching rail to the at least one inductor.

13. The circuit of claim 5, further comprising:

a processor that is capable of communicating with the display, the processor being capable of processing image data; and a memory device that is capable of communicating with the processor.

14. The circuit of claim 13, further comprising:

an image source module capable of sending the image data to the processor, wherein the image source module includes at least one of a receiver, transceiver, and transmitter.

15. The circuit of claim 13, further comprising:

an input device capable of receiving input data and to communicate the input data to the processor.

16. The circuit of claim 5, further comprising:

the segment driver circuit including the first switching circuit and the second switching circuit, the segment driver circuit being capable of sending at least one signal to the display.

17. The circuit of claim 16, further comprising:

a controller capable of sending at least a portion of the image data to the driver circuit.

18. The circuit of claim 5, wherein the first switching circuit is capable of selectively connecting at least one segment line of the plurality of segment lines to one of the power supply and the at least one inductor, and wherein the second switching circuit is capable of selectively connecting at least one segment line of the plurality of segment lines to one of the power supply and the at least one inductor.

19. A circuit for driving a MEMS device in a display including a plurality of segment lines, comprising:

a power source selectively coupled to the plurality of segment lines;

means for connecting one or more first segment lines to a first voltage;

means for connecting one or more second segment lines to a second voltage;

means for connecting the one or more first segment lines to the one or more second segment lines through at least one inductor, wherein the at least one inductor transfers charge between the one of more first segment line and the one or more second segment lines; and a segment driver circuit disconnecting the one of more first segment lines and the one of more second segment lines from the at least one indictor after a current in the at least one inductor rises and falls to substantially zero.

20. The circuit of claim 19, wherein the means for connecting the first segment line to the first voltage includes at least one first switch, the means for connecting the second segment line to the second voltage includes at least one second switch, and the means for connecting the first segment line to the second segment line through at least one inductor includes at least one third switch.

21. The circuit of claim 19, further comprising means for sensing the current through the at least one inductor.

22. A computer program product for processing data for a program capable of driving a display including a plurality of segment lines, comprising:

a non-transitory computer-readable medium having stored thereon code for causing a computer to:

connect a first segment line to a first voltage;

connect a second segment line to a second voltage;

connect the first segment line to the second segment line through at least one inductor;

transfer charge between the first and second segment lines through the at least one inductor; and disconnect the first segment line and the second segment line from the at least one inductor after the current in the at least one inductor rises and falls to substantially zero.

23. The computer program product of claim 22, further comprising code for causing the computer to connect the first segment line to the second voltage and the second segment line to the first voltage.

* * * * *